US011538389B2

(12) United States Patent
Kim

(10) Patent No.: US 11,538,389 B2
(45) Date of Patent: Dec. 27, 2022

(54) FIELD-SEQUENTIAL-COLOR DISPLAY DEVICE

(71) Applicant: RAONTECH, Inc., Seongnam-si (KR)

(72) Inventor: Min Seok Kim, Seongnam-si (KR)

(73) Assignee: RAONTECH, Inc.

( * ) Notice: Subject to any disclaimer, the term of this patent is extended or adjusted under 35 U.S.C. 154(b) by 0 days.

(21) Appl. No.: 17/474,213

(22) Filed: Sep. 14, 2021

(65) Prior Publication Data

US 2022/0093030 A1 Mar. 24, 2022

(30) Foreign Application Priority Data

Sep. 22, 2020 (KR) ..... 10-2020-0122120

(51) Int. Cl.
*G09G 5/10* (2006.01)
*G09G 3/20* (2006.01)

(52) U.S. Cl.
CPC ..... *G09G 3/2003* (2013.01); *G09G 5/10* (2013.01); *G09G 2300/0452* (2013.01); *G09G 2320/0626* (2013.01); *G09G 2340/06* (2013.01)

(58) Field of Classification Search
CPC ..... G09G 3/2003; G09G 5/10; G09G 2300/0452; G09G 2320/0626; G09G 2340/06; G09G 2310/0235; G09G 2320/0209; G09G 2320/0242; G09G 2360/16; G09G 2320/0666; G09G 2360/14
See application file for complete search history.

(56) References Cited

U.S. PATENT DOCUMENTS 7,046,221 B1 * 5/2006 Malzbender ..... G09G 3/3413 345/82
2010/0123696 A1 * 5/2010 Kobiki ..... G09G 5/00 345/207
2011/0243325 A1 * 10/2011 Ishii ..... G09G 3/20 345/589
2013/0342430 A1 * 12/2013 Huang ..... G09G 3/342 345/88
2017/0206689 A1 * 7/2017 Eo ..... G06T 11/60
2017/0256211 A1 * 9/2017 Miyata ..... G09G 3/3618
2021/0096409 A1 * 4/2021 Toyotaka ..... G02F 1/136227
2021/0151004 A1 * 5/2021 Kobayashi ..... H04N 9/30

FOREIGN PATENT DOCUMENTS

JP 2006-235443 A 9/2006
KR 10-2007-0013927 A 1/2007
KR 10-2014-0021026 A 2/2014

* cited by examiner

*Primary Examiner* — Antonio Xavier
(74) *Attorney, Agent, or Firm* — The Belles Group, P.C.

(57) ABSTRACT

Disclosed is a field-sequential-color display device sequentially driving a plurality of color fields divided from any one frame of a plurality of frames, including: a processor calculating a second field brightness-correction-value of a second color field based on a first field transition-brightness-value transferred from a first color field; and a display unit controlling the second color field based on the second field brightness-correction-value. Correction data is calculated by reflecting a brightness-value transited between color fields in a display to a non-linear brightness-value displayed in the corresponding field to minimize an error caused due to a difference between linear image data and a non-linear brightness-value displayed in the display.

8 Claims, 23 Drawing Sheets

FIELD-SEQUENTIAL-COLOR DISPLAY DEVICE

CROSS-REFERENCE TO RELATED APPLICATIONS

This application claims priority to and the benefit of Korean Patent Application No. 10-2020-0122120 filed in the Korean Intellectual Property Office on Sep. 22, 2020, the entire contents of which are incorporated herein by reference.

TECHNICAL FIELD

The present invention relates to a field-sequential-color display device, and more particularly, to a field-sequential-color display device for displaying an original color without color mixing by improving a phenomenon in which brightness displayed in a predetermined color field influences brightness of a continuous subsequent color field due to a low response speed of a display in a field sequential color display device which configures a plurality of color fields displaying a screen for each color in one frame configuring the screen and sequentially displays the configured color fields with a time difference to express a color.

BACKGROUND ART

When expressing colors in flat panel image display devices such as LCD and OLED, the brightness of each color is expressed individually in each RED, GREEN, and BLUE pixel expressing RED, GREEN, and BLUE colors as illustrated in FIG. 1A, and respective colors displayed in respective pixels are combined to display various desired colors.

However, in this R, G, and B pixel arrangement method, a Black Mask (BM) should be provided to distinguish between R, G, and B pixels and this makes it difficult to realize good image quality because a fill factor of the pixel is lowered. A display that has a higher response speed than a frame time may also use a field-sequential-color (FSC) method that configures a color field (subframe) for each color in one frame configuring the screen as illustrated in FIG. 1B and sequentially displays the configured color field as illustrated in FIG. 2B to express the color.

Since this method expresses the colors by time distinguishing in one pixel without distinguishing the pixels for each R, G, and B pixels by an area as in FIG. 1B, this method is a color display method which may implement a high fill factor and a high-definition pixel to be widely used in a liquid crystal ultra-small microdisplay such as LCOS, a digital mirror display (DMD), etc. A reflective display array is a method which sequentially displays RGB images of the corresponding color during a time period (hereinafter, referred to as a color field time) during which the corresponding color field is reproduced and sequentially illuminates RGB light sources corresponding thereto, and rapidly sequentially repeats RGB color fields displaying only corresponding field brightness, respectively at respective color field times to implement images of colors finally combined in a frame unit.

FIG. 2A illustrates a timing when which an RGB parallel color-value is input into a display having an arrangement of R, G, and B pixels, and FIG. 2B illustrates a timing when RGB sequential color-values are input into a field-sequential-color display. In a field-sequential-color expression method, the color is divided and displayed into a color field or a subframe corresponding to each color within one frame time and the color fields operate at a time of ⅓ or less of the frame time. Since each color is displayed respectively at a different time, a separation phenomenon of the color from the screen may occur, and as a result, the color fields corresponding to each color operate at least three times or much faster than the frame time.

In the FSC method, since a short-time color field (subframe) is displayed several times within one frame time, a response time of the display element should be smaller than the color field time to reliably distinguish the pixel brightness for each color field as in FIG. 3A. However, since an actual display element has a response delay time, when the response time is longer than the color field time as in FIG. 3B, a part of brightness expressed in one color field is transited to a subsequent color field to influence the brightness of the corresponding color field, and as a result, a problem in the colors are mixed is caused. In some cases, since one frame includes four or more color fields, a faster color field is required, and color mixing may be shown even more severe. Since a brightness response curve of a gamma corrected general display has a non-linear characteristic of a gamma function as in FIG. 3C, a color-value difference $\Delta x$ in a low gray scale and a color-value difference $\Delta y$ in a high gray scale are significantly different with respect to the same brightness change ($\Delta B(\Delta x)=(\Delta y)$). Therefore, since an influence which a transition-brightness-value exerts on the brightness of the low gray scale and an influence which the transition-brightness-value exerts on the brightness of the high gray scale are different from each other, only when the influence is not calculated based on the color-value in brightness correction, but only when the transition-brightness-value is added to or subtracted from the brightness-value expressed by the color-value, the brightness correction considering the non-linear characteristic of the display may be performed.

SUMMARY OF THE INVENTION

The present invention has been made in an effort to provide a method for expressing a vivid color with excellent color expression by improving a problem in that colors are mixed due to a difference between a response time of a display element and a reproduction time of a color field (subframe), and as a result, an accurate color cannot be implemented in a field-sequential-color display device.

An exemplary embodiment of the present invention provides a field-sequential-color display device sequentially driving a plurality of color fields divided from any one frame of a plurality of frames which may include: a processor calculating a first field transition-brightness-value influencing a brightness of a second color field driven next to a first color field from a first field brightness-value corresponding to a first field color-value of the first color field, calculating a second field correction-brightness-value from a second field brightness-value corresponding to a second field color-value of a second color field driven next to the first color field by referring to the first field transition-brightness-value, and calculating a second field brightness-correction-value from the second field correction-brightness-value; and a display unit outputting a field brightness-value corresponding to the calculated second field brightness-correction-value. Further, the processor may calculate a second field transition-brightness-value influencing a third field brightness from the second field correction-brightness-value.

The processor may calculate a predetermined first field transition-brightness-value which is a part of the first field brightness-value, correct a second field brightness-value to be displayed by the second field color-value, and apply the corrected second field brightness-value to the calculation of the second field correction-brightness-value.

The processor may determine the predetermined first field transition-brightness-value by referring to at least one of the first field brightness-value, a response time of a display element, and a time of a color field.

The processor may calculate a second field correction-brightness-value by adding or subtracting the predetermined first field transition-brightness-value to or from the second field brightness-value and calculate the second field brightness-correction-value from a color-value relation corresponding to a field brightness value of a display element.

The display unit may calculate a second field correction-brightness-value by adding or subtracting the predetermined first field transition-brightness-value to or from the second field brightness-value and output a second field brightness correction image by transferring a field brightness-correction-value corresponding to the second field correction-brightness-value acquired from the color-value relation corresponding to the field brightness-value of the display element to a display pixel array.

The processor may simultaneously receive a plurality of color-values corresponding to the plurality of color fields and calculate a plurality of field brightness-values and field correction-brightness-values corresponding to the plurality of field color-values, respectively, and then field brightness-correction-values corresponding to field correction-brightness-values, respectively, and then sequentially output the stored field brightness-correction-values, and the display unit may sequentially display field brightness correction images corresponding to the plurality of input field brightness-correction-values, respectively.

The processor may simultaneously receive a plurality of color input values corresponding to the plurality of color fields and calculate the first field brightness-correction-value corresponding to a first field color-value of the first color field, the display unit may output a first field brightness correction image corresponding to the first field brightness-correction-value, and then the processor may calculate the second field brightness-correction-value corresponding to a second field color-value of the second color field, and the display unit may sequentially output a second field correction image corresponding to the second field brightness-correction-value.

The processor refers to a field transition-brightness-value corresponding to a last color field last driven among a plurality of color fields divided from a first frame to calculate a field correction-brightness-value of an initial color field initially driven among a plurality of color fields divided from a second frame driven next to the first frame and output a field brightness-correction-value corresponding to the field correction-brightness-value.

A field brightness-value calculation unit may store a relation between the field color input value and the field brightness-value displayed in the display element in a separate mapping table form, and the processor may read a relation between the field color-value and the field brightness-value stored in the field brightness vale calculation unit, and calculate the field brightness-value.

A field brightness-correction-value calculation unit may store a relation between the field brightness-value displayed in the display element and a field color-value in a separate mapping table form, and the processor may read the relation between the field color-value and the field brightness-value stored in the field brightness-correction-value calculation unit, and calculate the field brightness-correction-value.

A field correction-brightness-value calculation unit may define a relation equation between the field brightness-value by the field color-value and the field transition-brightness-value, and the processor may calculate the field correction-brightness-value for the corresponding field color-value according to a calculation equation of the field correction-brightness-value calculation unit.

A field transition-brightness-value calculation unit may define a field brightness-value transited to a subsequent field by a relation equation by considering a frame time of a display, a response time of the display, etc., and the processor may calculate the corresponding field transition-brightness-value according to the calculation equation of the field transition-brightness-value calculation unit and use and apply the field transition-brightness-value to calculation of the field correction-brightness-value.

A field transition-brightness-value storage unit is configured in the form of a frame buffer, and the processor may sequentially read field transition-brightness-values of the previous color field (subframe) stored in the field transition-brightness-value storage unit and apply the read field transition-brightness-values to the calculation of the field correction-brightness-value.

According to an exemplary embodiment of the present invention, there is an advantage of providing a method which expresses a vivid color with excellent color expression power by improving a problem in that color brightness of R, G, and B which should be sequentially distinguished and expressed are mixed due to a difference between a time of a color field and a response time of a display element in a field-sequential-color display device. Further, correction data is calculated by reflecting a brightness-value transited between color fields in a display to a non-linear brightness-value displayed in the corresponding field to minimize an error caused due to a difference between linear image data and a non-linear brightness-value displayed in the display.

DETAILED DESCRIPTION

Figure 1A:
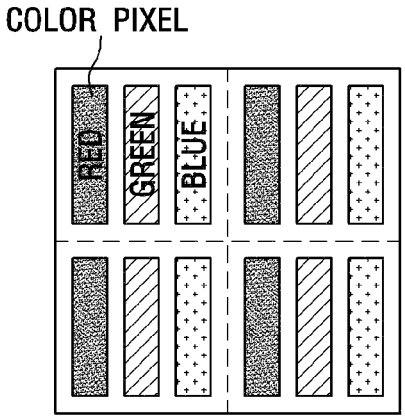
FIGS. 1A-B illustrate an example of an RGB pixel arrangement in a general flat panel display and RGB color expression of a field-sequential-color method.
Figure 1B:
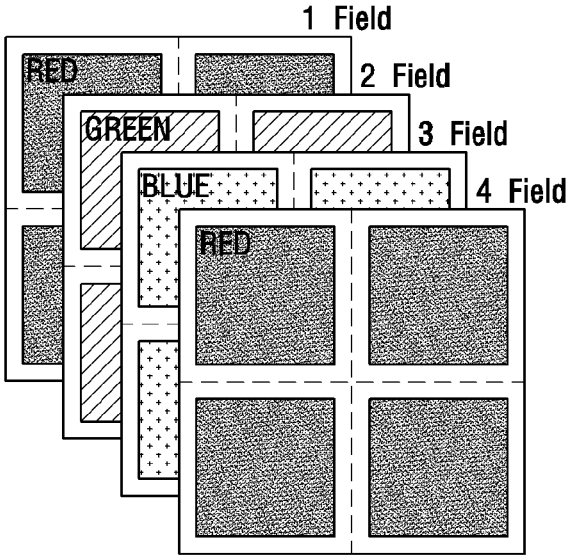
Figure 2A:
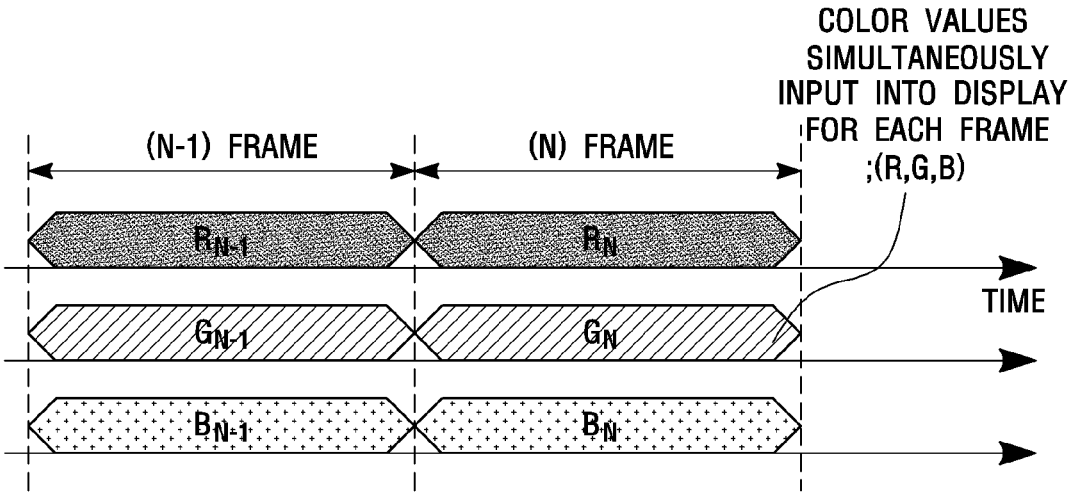
FIGS. 2A-B illustrate an example of RGB color-values and timings of a general RGB array display and a field sequential color display.
Figure 2B:
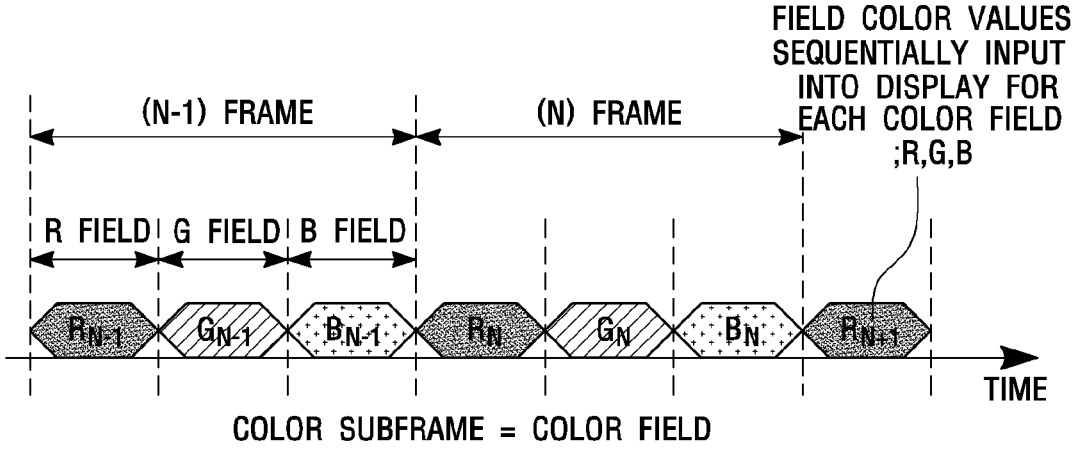

Hereinafter, exemplary embodiments disclosed in the present disclosure will be described in detail with reference to the accompanying drawings and the same or similar components are denoted by the same reference numerals regardless of a sign of the drawing, and duplicated description thereof will be omitted. Suffix "unit" for components used in the following description is given or mixed in consideration of easy preparation of the present disclosure only and does not have their own distinguished meanings or roles.

In describing the embodiment of the present disclosure, a detailed description of related known technologies will be omitted if it is determined that the detailed description makes the gist of the embodiment disclosed in the present disclosure unclear. Further, it is to be understood that the accompanying drawings are just used for easily understanding the exemplary embodiments disclosed in the present disclosure and a technical spirit disclosed in the present disclosure is not limited by the accompanying drawings and all changes, equivalents, or substitutes included in the spirit and the technical scope of the present disclosure are included.

Terms including an ordinary number, such as first and second, are used for describing various constituent elements, but the constituent elements are not limited by the terms. The terms are used only to discriminate one component from another component.

It should be understood that, when it is described that a component is "connected to" or "accesses" another component, the component may be directly connected to or access the other component or a third component may be present therebetween. In contrast, when it is described that a component is "directly connected to" or "directly accesses" another component, it is understood that no element is present between the element and another element. A singular form includes a plural form if there is no clearly opposite meaning in the context.

In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

Hereinafter, an exemplary embodiment of the present invention will be described in detail with reference to the accompanying drawings. Prior to specific description, in the present invention, a basic display interval configuring one screen for each color may be referred to as a color field (R field, G field, and B field), and this may be defined as the same meaning as a subframe configuring a screen having a single-color image.

Figure 4A:
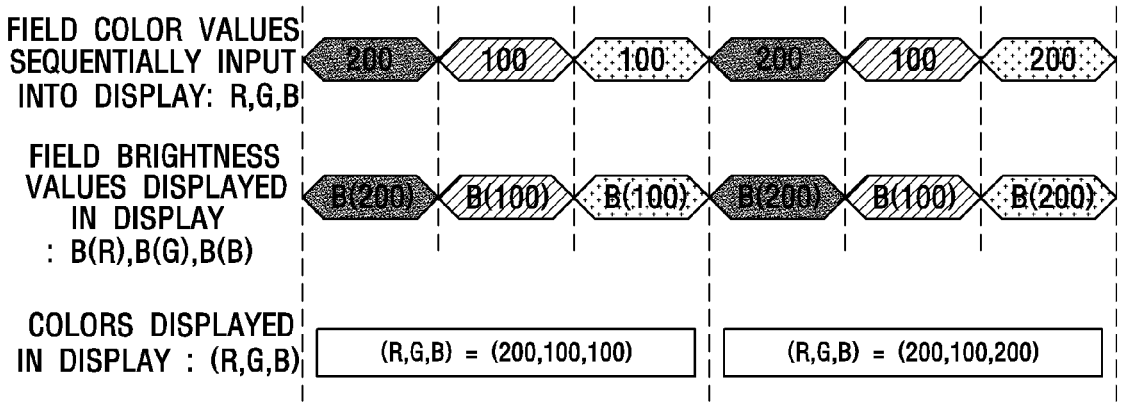
FIGS. 4A to 4C illustrate an example for a relation between a field color-value and a display output for specifically describing a phenomenon of color mixing, which occurs in a field-sequential-color method and a concept for correcting the phenomenon.

In displaying R, G, and B colors illustrated in FIG. 4A in the field-sequential-color display device, when field color-values (R field; 200, G field: 100, and B field: 100) of each color field are sequentially input into a display pixel array, brightness images having field brightness-values B(200), B(100), and B(100) are expressed in respective color fields, respectively to express combined colors {B(200), B(100), B(100)} in the frame unit.

Figure 4B:
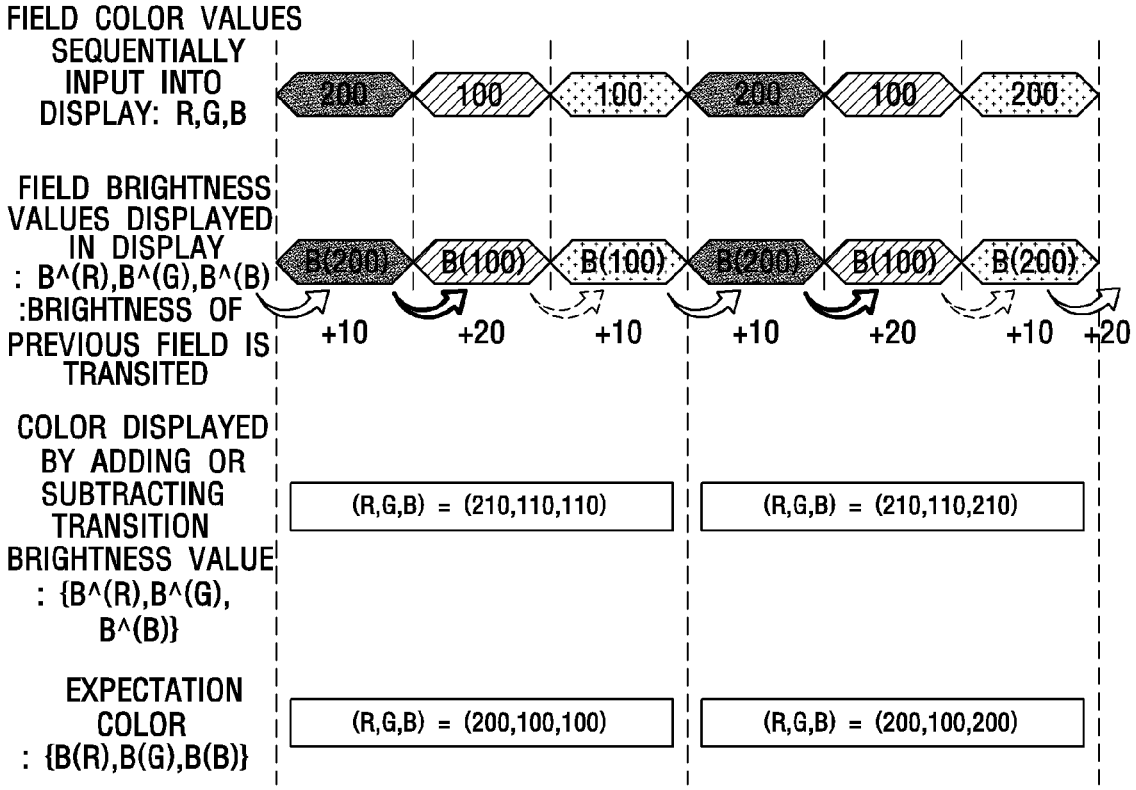

However, since a partial brightness (e.g., 10% of the brightness) of an image displayed in a predetermined subframe (color field) is transited to the subsequent field as illustrated in FIG. 4B due to a brightness response delay in an actual display, even though the field color-values (R field; 200, G field: 100, and B field: 100) are input into each color field, the brightness is combined with the transited brightness-value to express B(210), B(120), B(110) or B^(200), B^(100), ^(100), and as a result, a phenomenon in which a modified color is expressed like {B(210), B(120), B(110)}={B^(200), B^(100), B^(100)} in the frame unit occurs. That is, 20 which is 10% of the R field brightness-value is reflected to the G field brightness, and 10 which is 10% of the G field brightness-value influences the B field brightness, and 10 which is 10% of the B field brightness-value influences the R field brightness again to express the color of the displayed image as a modified color like (210, 120, 110) other than (200,100,100). As such, a predetermined field transition-brightness-value transited from the previous field to the subsequent field corresponds to some (a portion) of brightness-values of the previous field. In the above description, it is exemplarily described that since 10% of the brightness-values of the previous field is transited to the subsequent field, but a brightness-value of a different ratio therefrom will be able to be transited. In addition to the brightness of the previous input image, the amount of brightness which is transited may be experimentally determined through measurement according to a scheme of setting a driving condition of the display unit 100 by considering a frequency (time) of the color field (subframe), the response time of the display element, display driving voltage, etc. The scope of the present invention is not limited to a specific transition ratio.

Figure 4C:
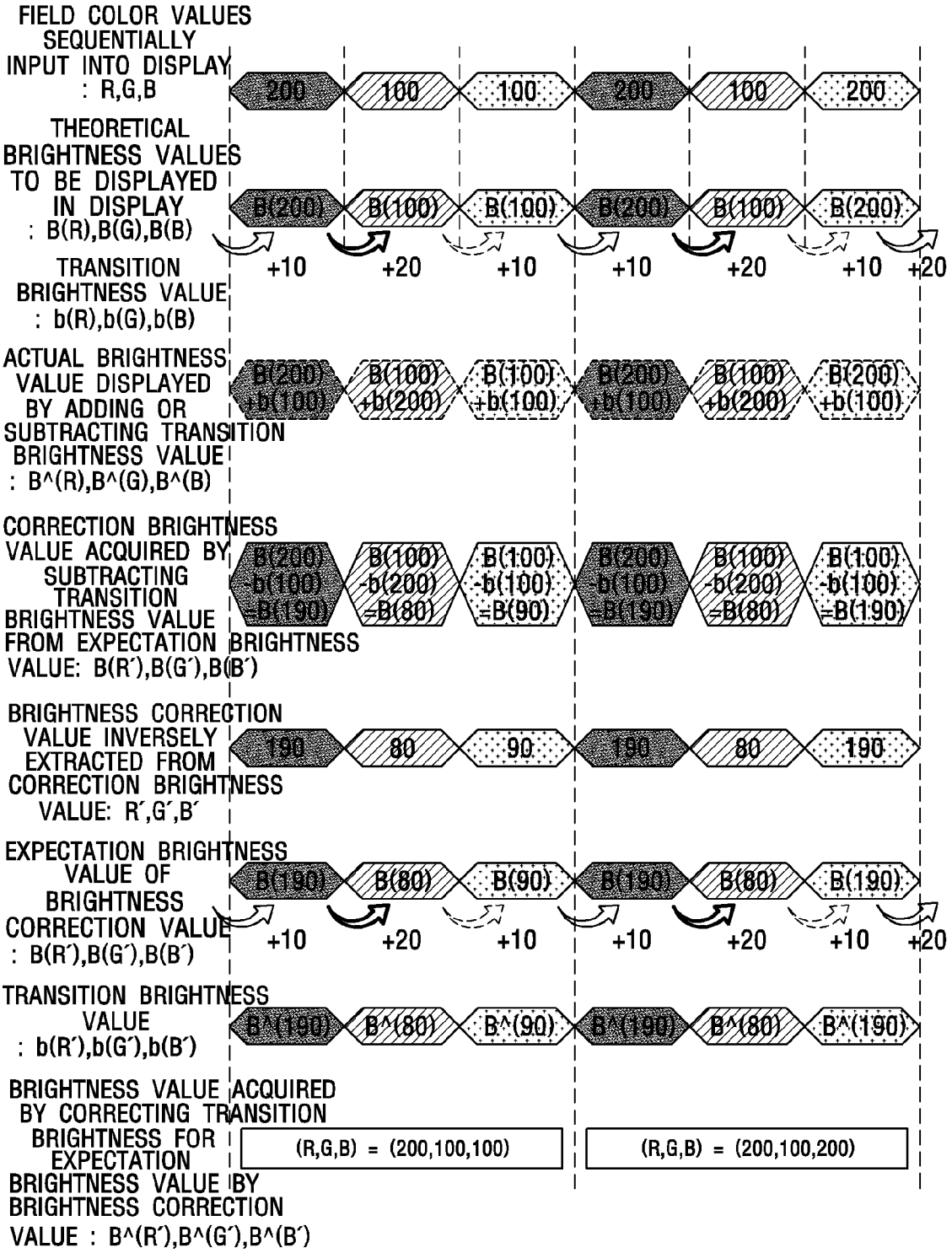

As in FIG. 4C, brightness-values [b(B), b(R), b(G)] transited from the previous color field to a current color field are added to and subtracted from expected field brightness-values {B(R), B(G), B(B)} of the field color-values of the current color field to calculate a field correction-brightness-value of the current color field and field brightness-correction-values (R', G', B') calculated from the corrected field correction-brightness-values are input into the display pixel array, and as a result, brightness-values {B(R'), B(G'), B(B')} according to the corrected input values, and transition-brightness-values {b(B'), b(R'), b(G')} are combined to display an image {B^(R')=200, B^(G')=100, B^(B')=100} having a desired brightness in the current color field.

When specifically described by referring back to FIG. 4C, the transition-brightness-values {10, 20, 10} transited from the previous color field to the current color field are added to the expected field brightness-values {B(200), B(100), B(100)} corresponding to (R field: 200, G field: 100, B field: 100) (three fields illustrated at a left side of FIG. 4C) which are the field color-values of the current color field, actual brightness-values {210, 120, 110} are obtained. In order to correct this, when the correction-brightness-values (B(R')=190, B(G')=80, B(B')=90) are calculated by subtracting the transition-brightness-values (b(R)=10, b(G)=20, b(B)=10) from the expected brightness-values {(200), B(100), B(100)}, and the field brightness-correction-values (R'=190, G'=80, B'=90) inversely extracted from the correction-brightness-values are input into the display pixel array, a color-value of a desired brightness (B^(R')=200, B^(G')=100, B^(B')=100) may be displayed.

Similarly, the color-value of the desired brightness (B^(R')=200, B^(G')=100, B^(B')=200) may be displayed in the same scheme even with respect to (R field: 200, G field: 100, B field: 200) (three fields illustrated in FIG. 4C) which are the field color-values of the current color field.

Specifically, brightness correction processors 300, 400, and 500 (see FIGS. 9 to 11) proposed in the present invention calculate the corrected field correction-brightness-value by subtracting a brightness-value corresponding to the value of the previous color field which is to be transited to the current color field from the expected field brightness-value of the current color field and calculate the field brightness-correction-values (R': 190, G': 80, B': 90) from the calculated field correction-brightness-value and sequentially output the field brightness-correction-values (R': 190, G': 80, B': 90) to the display unit 100. For example, when the brightness-correction-value (R=190) is input into the display unit 100 in the R field, 10% {b(B)} of the field brightness-value of the previous B field is transited and displayed as {B(190)+b(100)}, and when the brightness-correction-value (G'=80) is input in the G field, 10% {b(R)} of the brightness-value of the previous R field transited and displayed as {B(80)+b(200)}, and when the brightness-correction-value (B'=90) is input in the B field, 10% {b(G)} of the brightness-value of the previous G field is transited and displayed as {B(90)+b(100)}, thereby displaying a color having a desired brightness {B^(R')=200, B^(G')=100, B^(B')=100}.

The brightness correction processors 300, 400, and 500 refers to a field brightness-value corresponding to a last color field that is lastly driven among a plurality of color fields divided from a first frame to calculate a field brightness-correction-value corresponding to an initial color field initially driven among a plurality of color fields divided from a second frame driven next to the first frame. That is, a field correction-brightness-value corresponding to an initial R field of the second frame may be calculated as 10 which is 10% of 100 which is the field brightness-value of the B field which is the last color field of the first frame.

In FIGS. 4A to 4C, it is illustrated that 10% which is some (a portion) of the brightness displayed by the previous field color-values is transited to the subsequent image, but this is just an example, and in addition to the brightness of the previous input image, the amount of brightness which is transited may be experimentally determined through measurement according to a scheme of setting a driving condition of the display unit 100 by considering a frequency (time) of the color field (subframe), the response time of the display element, display driving voltage, etc. An object of the present invention is to apply a method and a device for expressing a vivid color by improving a problem in that an accurate color may not be implemented due to mixing of colors due to a difference between the response time of the display element and the subframe (field) reproduction time in the field-sequential-color (FSC) display device as described above.

Figure 5A:
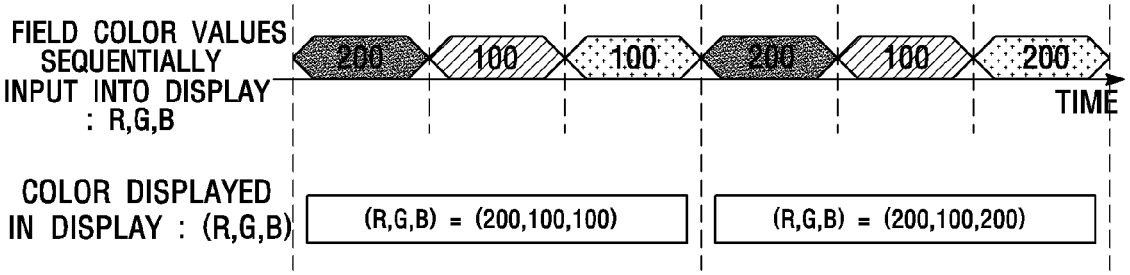
FIGS. 5A to 5C illustrate a comparison example for describing a phenomenon of color mixing, which occurs in a field sequential color method and a concept for correcting the phenomenon in a continuous color field input/output situation.
Figure 5B:
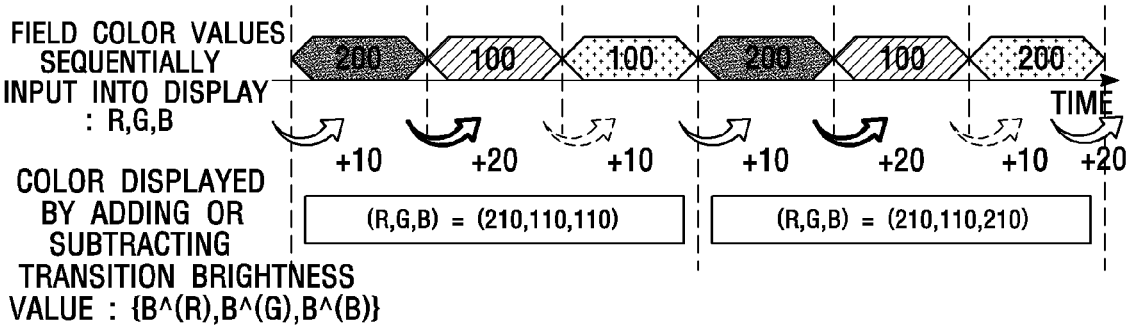
Figure 5C:
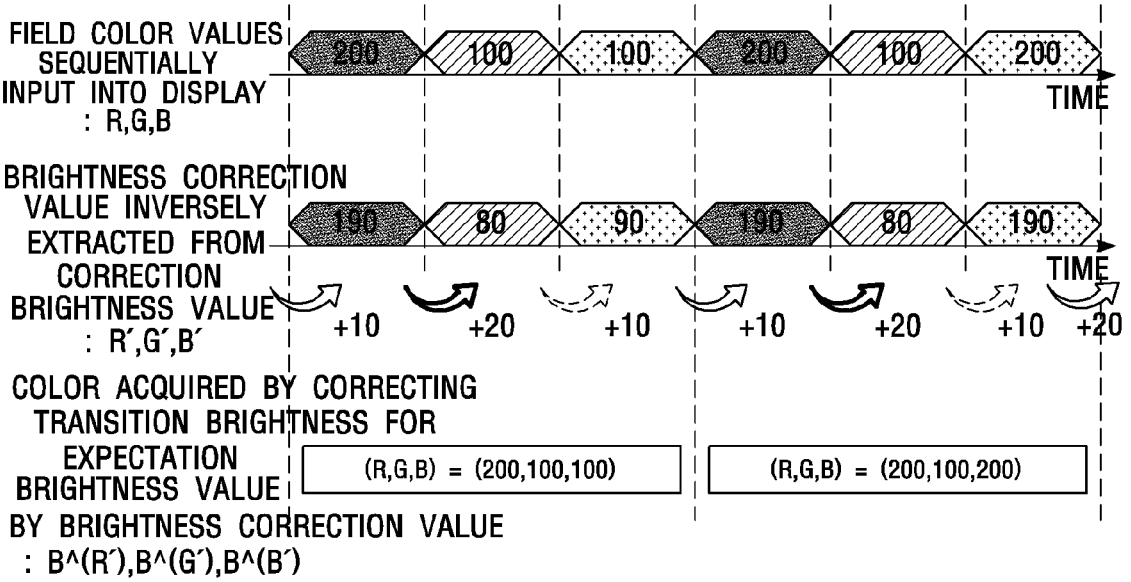

FIGS. 4A to 4C illustrate each of a color mixing phenomenon based on one frame and a concept for correcting the color mixing phenomenon, while FIGS. 5A to 5C illustrate a color mixing phenomenon based on a plurality of frames, and a concept for correcting the color mixing phenomenon as a comparison example form.

FIG. 5A illustrates a theoretical display result as in FIG. 4A, FIG. 5B illustrates a substantial display result as in FIG. 4B, and FIG. 5C illustrates a transited value illustrated in FIG. 4C and a field brightness-correction-value input into the display unit 100 considering the transited value, and illustrates a result color acquired by outputting a result value acquired by aggregating the brightness-value by inputting the calculated field brightness-correction-value and the transited brightness-value through the display unit 100.

Figure 6A:
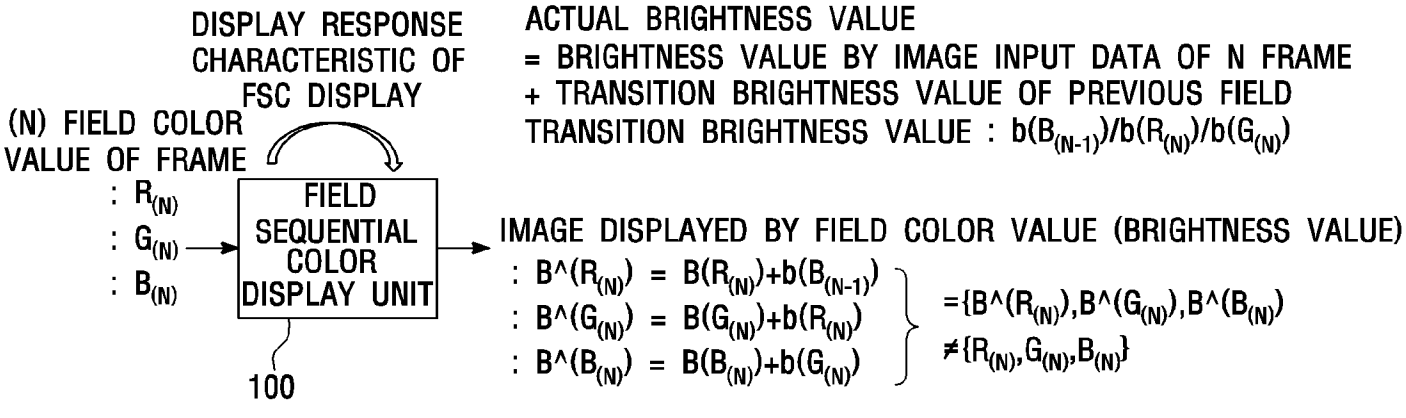
FIGS. 6A and 6B illustrate an example for describing a processing step of correcting a color mixing phenomenon due to a transition-brightness-value of a field-sequential-color display device proposed in the present invention.

As illustrated in FIG. 6A, the output color of the field sequential color display unit 100 is determined according to a transition response characteristic defined by aggregation of the RGB field brightness of the corresponding field color-value and the brightness transited from the previous field with respect to the sequential field color-values (R>G>B). In the present invention, a display response characteristic (brightness-value transition) of the FSC display as a unique characteristic of the display element may be changed by the response speed, the field time (frequency), the driving voltage, etc., of the display element.

Output color of the field sequential color display: (hereinafter, N and N−1 mean the frame order (not the subframe order))

As described below, the brightness of each field is displayed as the sum of the display brightness by the sequential field color-value of the corresponding field and the brightness transited from the previous field.

$$\{B(R_{(N)})+b(B_{(N-1)}),\ B(G_{(N)})+b(R_{(N)}),\ B(B_{(N)})+b(G_{(N)})\}=\{\hat{B}(R_{(N)}),\ \hat{B}(G_{(N)}),\ \hat{B}(B_{(N)})\}\neq\{R_{(N)},\ G_{(N)},\ B_{(N)}\}$$

Figure 6B:
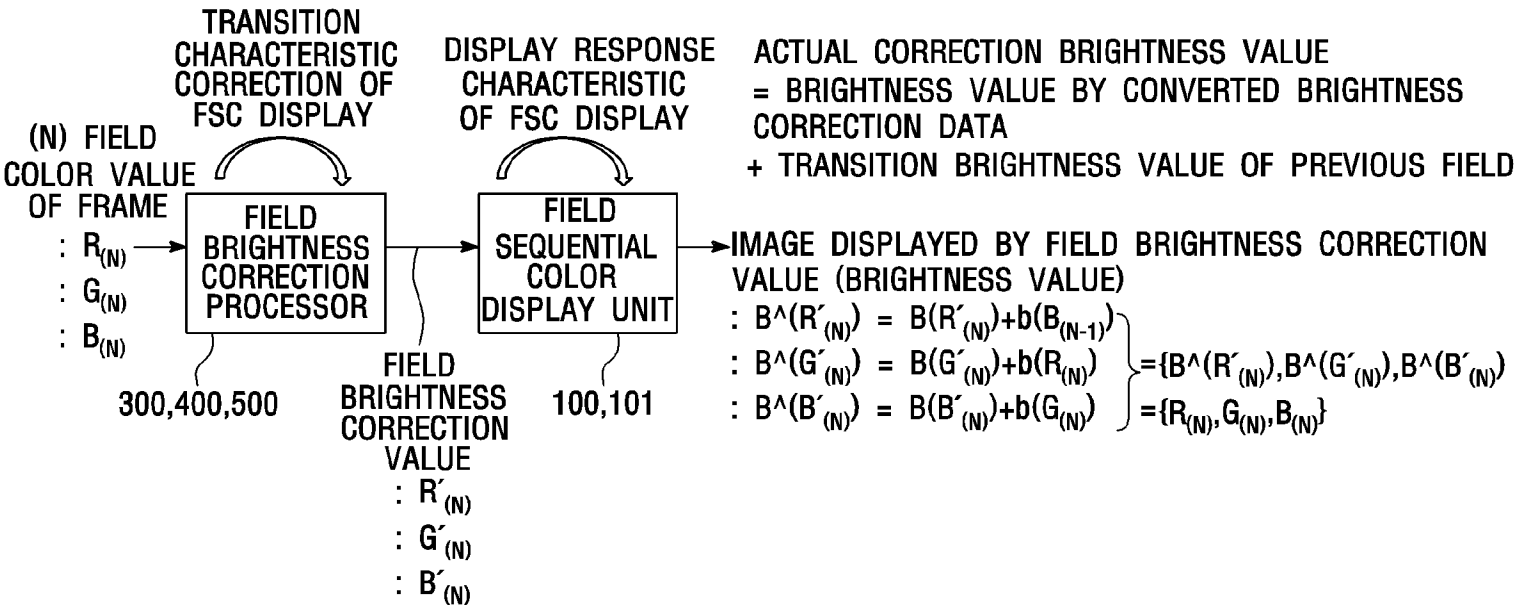

$\hat{B}(R_{(N)})=B(R_{(N)})+b(B_{(N-1)})$: Actual brightness of R field to which brightness is transited $\hat{B}(G_{(N)})=B(G_{(N)})+b(R_{(N)})$: Actual brightness of G field to which brightness is transited $\hat{B}(B_{(N)})=B(B_{(N)})+b(G_{(N)})$: Actual brightness of B field to which brightness is transited $B(R_{(N)})$: Field brightness-value to be displayed by field color-value $R_{(N)}$ $B(G_{(N)})$: Field brightness-value to be displayed by field color-value $G_{(N)}$ $B(B_{(N)})$: Field brightness-value to be displayed by field color-value $B_{(N)}$ $b(R_{(N)})$: Brightness-value transited to subsequent field by field color-value $R_{(N)}$ $b(G_{(N)})$: Brightness-value transited to subsequent field by field color-value $G_{(N)}$ $b(B_{(N)})$: Brightness-value transited to subsequent field by field color-value $B_{(N)}$ N: Frame Order of subframes is R, G, B, and R A processing step for correcting a color expression distorted due to the transition response characteristic of the field sequential color display is illustrated in FIG. 6B. The transition-brightness-value is anticipated, and a corrected brightness-value is calculated by subtracting the anticipated transition-brightness-value from the expected field brightness-value, and a brightness-correction-value corresponding to the corrected brightness-value is calculated and output, thereby achieving a desired brightness including the transmission brightness in the FSC display device. The expected field brightness-value and the field transition-brightness-value are calculated from the transition response characteristic of the field sequential color display unit 100, and the field brightness correction processors 300, 400, and 500 convert and output the expected field brightness-value and the field transition-brightness-value into brightness correction data.

Figure 7A:
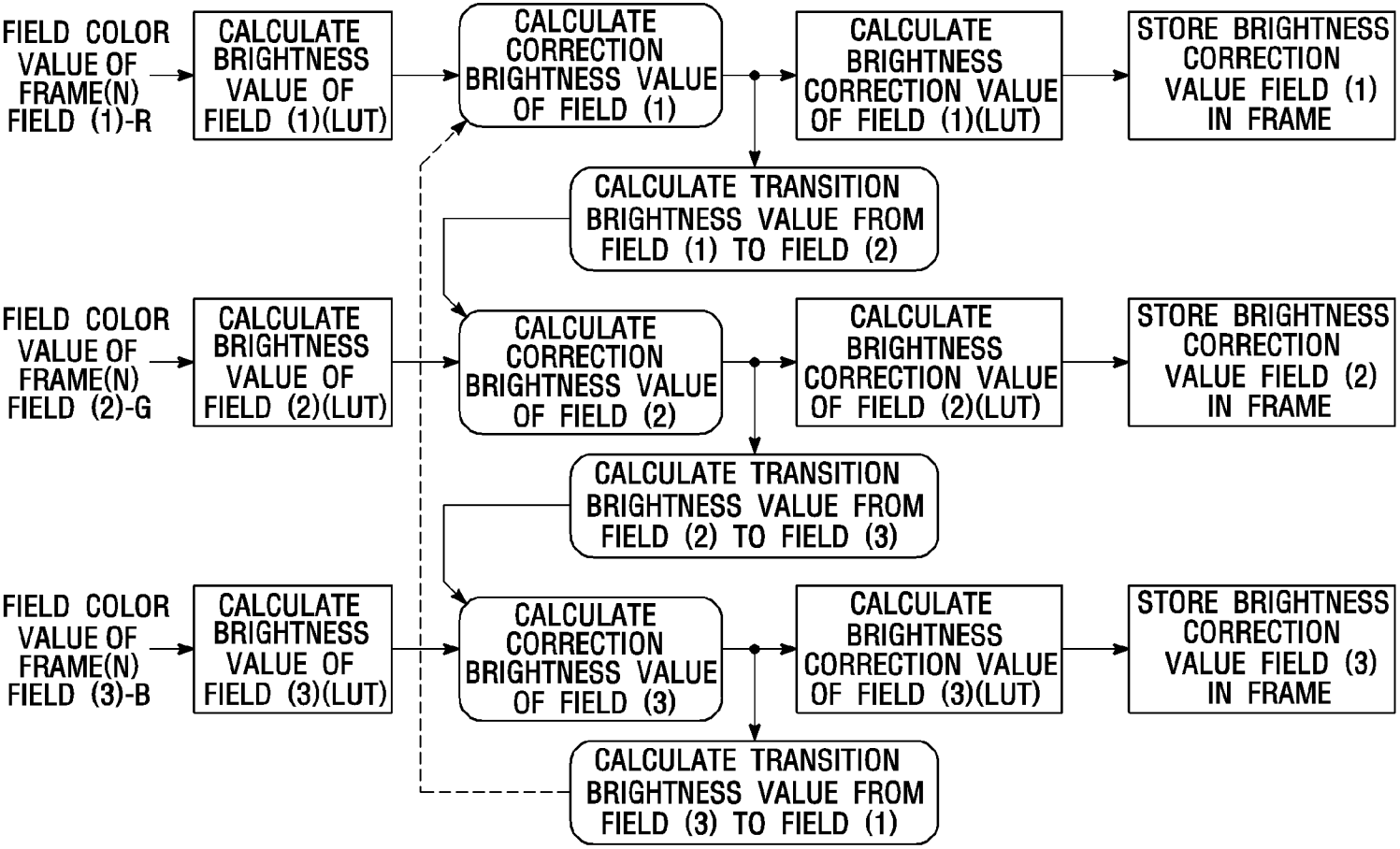
FIGS. 7A and 7B illustrate an example of schematizing two configurations of a system that processes a field color-value correction conversion process of a field-sequential-color display device proposed in the present invention.
Figure 7B:
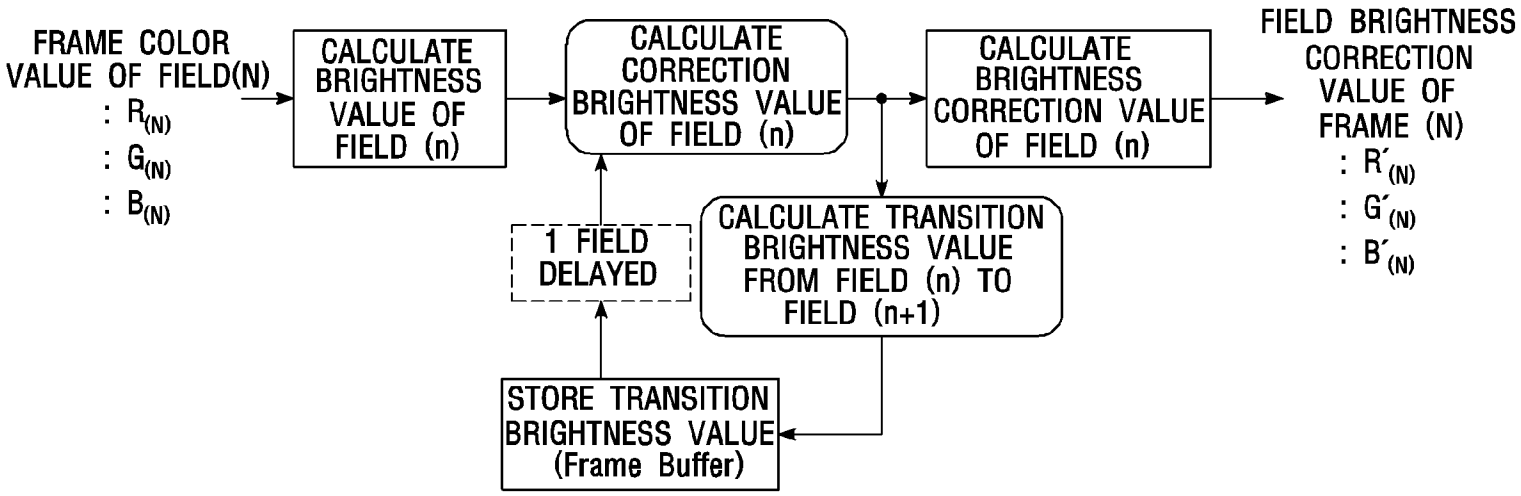

$B(R_{(N)})-b(B_{(N-1)})$: Field correction-brightness-value acquired by excluding field transition-brightness-value anticipated from B field from expectation field brightness-value of R field $B(G_{(N)})-b(R_{(N)})$: Field correction-brightness-value acquired by excluding field transition-brightness-value anticipated from R field from expectation field brightness value of G field $B(B_{(N)})-b(G_{(N)})$: Field correction-brightness-value acquired by excluding field transition-brightness-value anticipated from G field from expectation field brightness value of B field $R'_{(N)}$: R field brightness-correction-value calculated from R field correction-brightness-value $G'_{(n)}$: G field brightness-correction-value calculated from G field correction-brightness-value $B'_{(N)}$: B field brightness-correction-value calculated from B field correction-brightness-value $\hat{B}(R'_{(N)})=B(R'_{(N)})+b(B_{n-1})$: Corrected brightness of R field displayed in field sequential color display unit by R field brightness-correction-value $\hat{B}(G'_{(N)})=B(G'_{(N)})+b(R_{(N)})$: Corrected brightness of G field displayed in field sequential color display unit by G field brightness-correction-value $\hat{B}(B'_{(N)})=B(B'_{(N)})+b(G_{(N)})$: Corrected brightness of B field displayed in field sequential color display unit by B field brightness-correction-value $\{\hat{B}(R'_{(N)}), \hat{B}(G'_{(N)}), \hat{B}(B'_{(N)})\}=(R_{(N)}, G_{(N)}, B_{(N)})$ Corrected output color displayed in field sequential color display unit FIGS. 7A and 7B illustrate an example of schematizing a field color-value correction conversion process of a field-sequential-color display device proposed in the present invention, and FIG. 7A illustrates a field color-value brightness correcting process and a field brightness-correction-value storing process when color-values are input in an RGB parallel form and FIG. 7B illustrates a brightness correcting process and a transition-brightness-value storing process when colors values are distinguished for each color field and input in a sequential FSC-RGB form.

Figure 8:
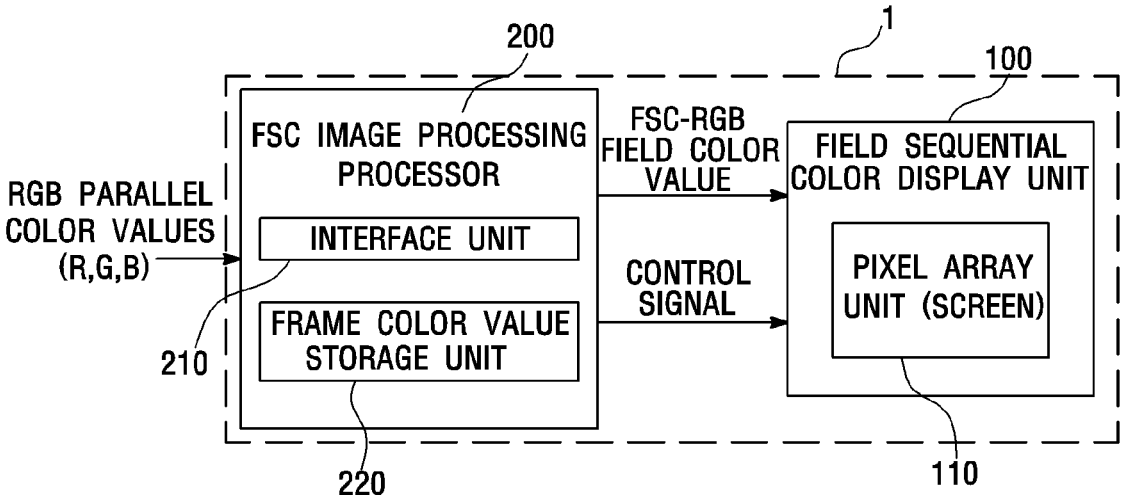
FIG. 8 is a configuration diagram of a field-sequential-color display device constituted by an existing FSC image processor that sequentially outputs field color-values according to a color field order after receiving and temporarily storing an RGB parallel color-value, and an FSC display unit.
Figure 9:
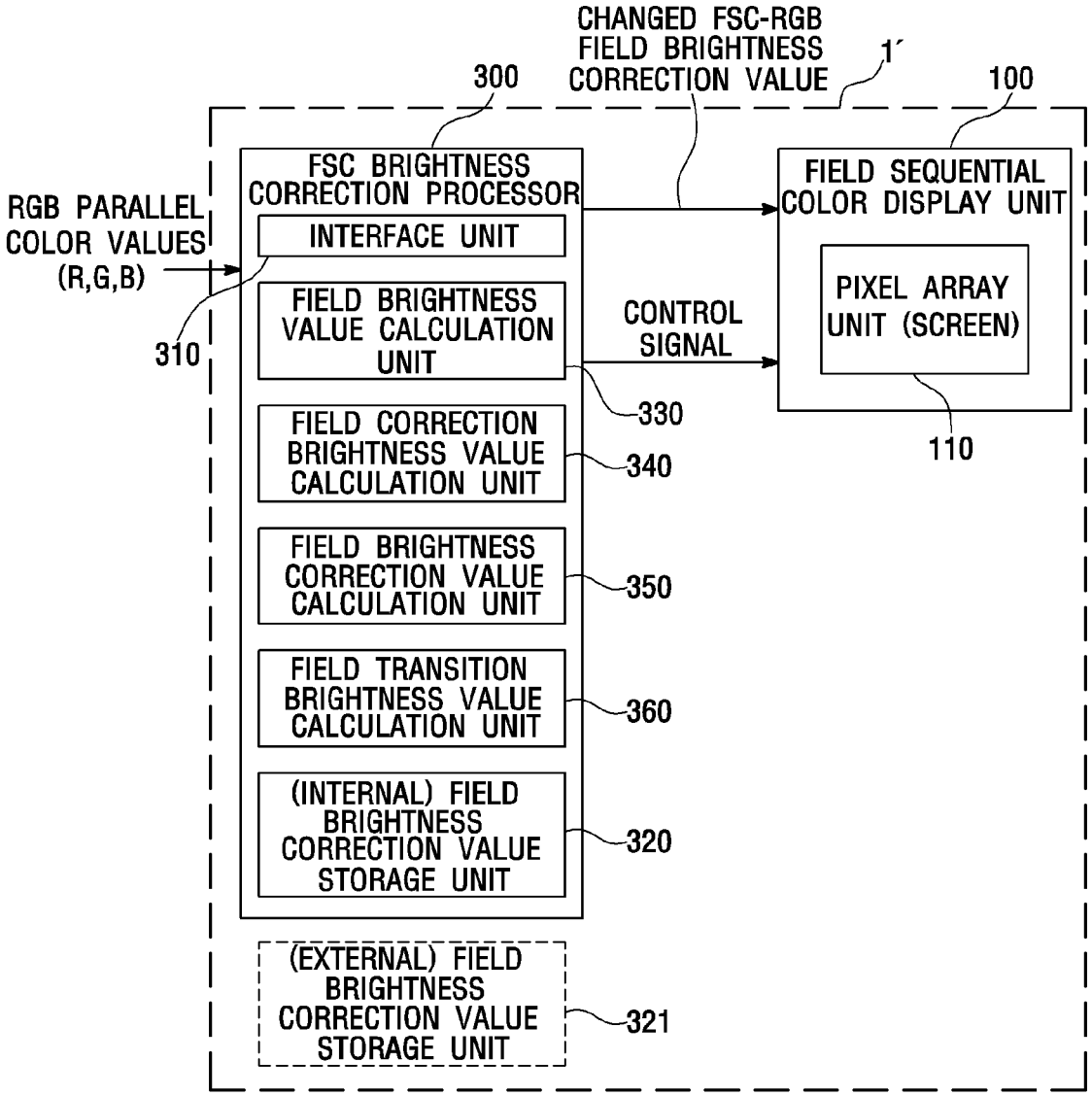
FIG. 9 is a configuration diagram of a brightness correction field-sequential-color display device constituted by an FSC brightness correction processor that receives a general RGB parallel color-value, calculates and stores a field brightness-correction-value, and sequentially outputs an FSC-RGB field brightness-correction-value, according to another embodiment of the present invention.
Figure 10:
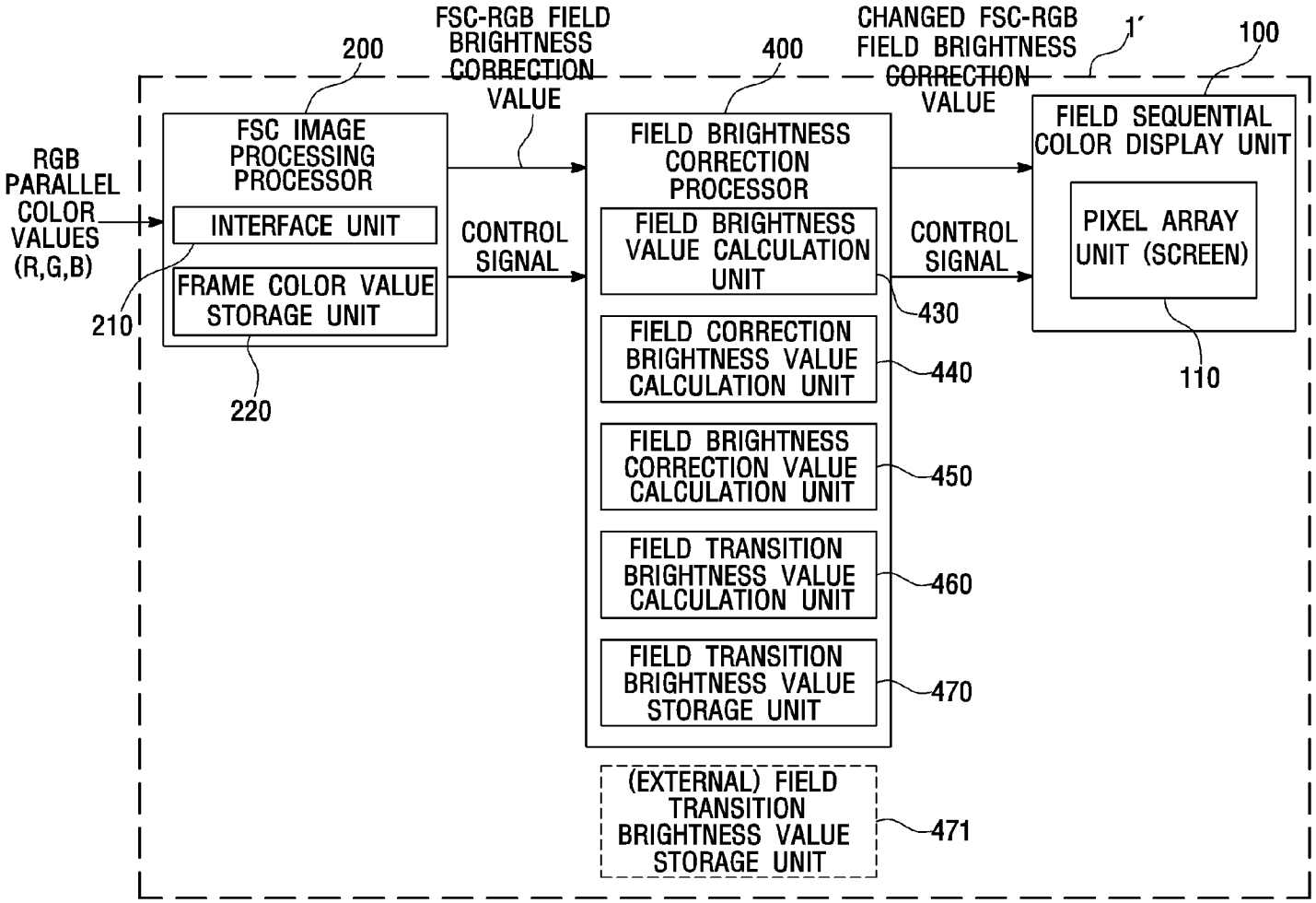
FIG. 10 is a configuration diagram of a field-sequential-color display device constituted by a separate field transition brightness correction processor that sequentially receives field color-values from an existing FSC image processing processor, and corrects the color-values, and sequentially outputs FSC-RGB field brightness-correction-values, and an FSC display unit, according to another embodiment of the present invention.
Figure 11:
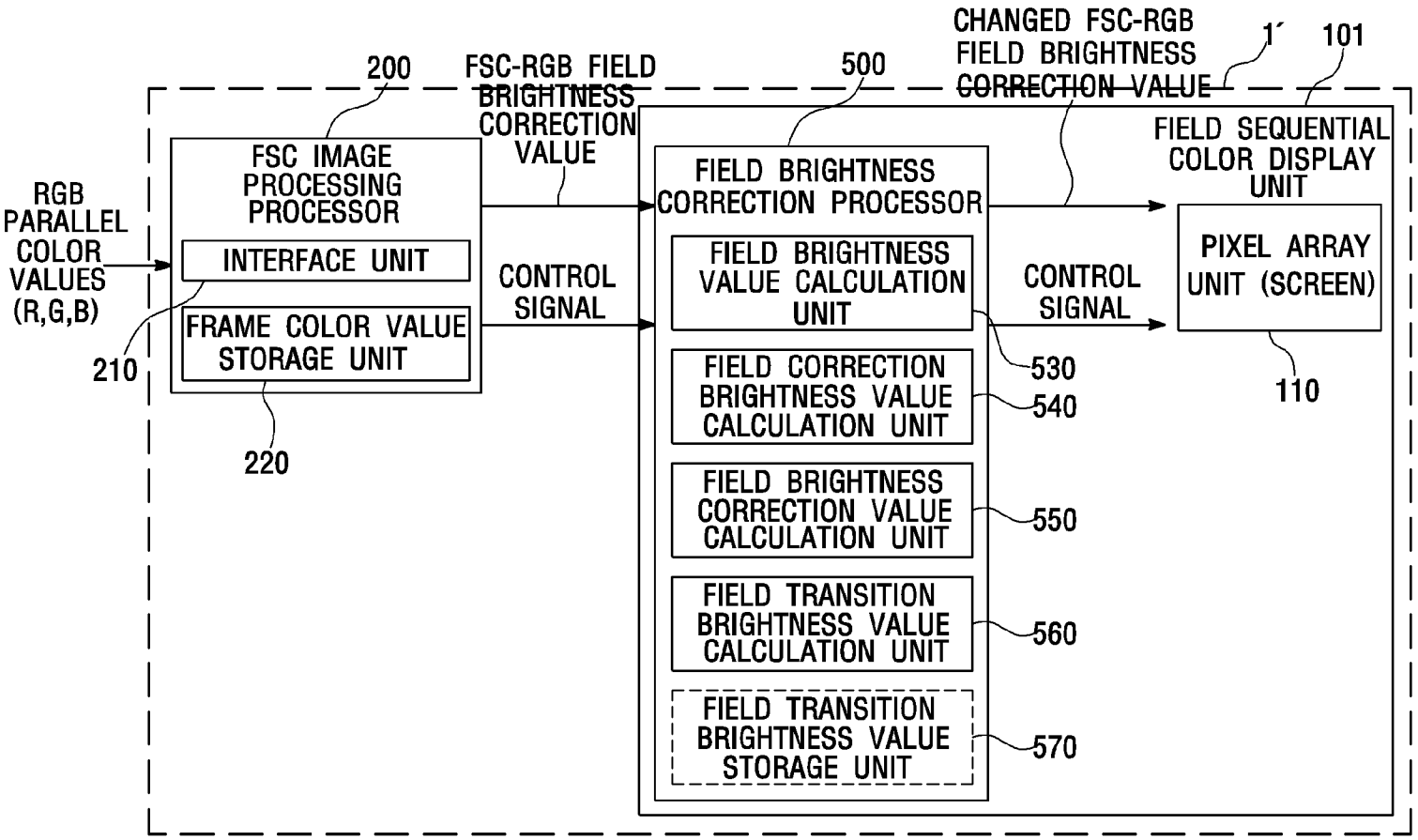
FIG. 11 is a configuration diagram of a field-sequential-color correction display device in which an existing FSC image processor and a field transition brightness correction processor are included in an FSC display unit, according to another embodiment of the present invention.

FIG. 8 is a block diagram of a field-sequential-color display device 1 in the related art and FIGS. 9 to 11 are block diagrams of a field-sequential-color display device 1' compared with the field-sequential-color display device 1. Since the display response characteristic of the FSC display applied to FIGS. 8 to 11 as a characteristic which may be different for each display element, is changed by the response speed, the field time (frequency), the driving voltage, etc., of the display element, the transition-brightness-value for each color is calculated through an experiment value.

The conventional field-sequential-color display device 1 includes an FSC image processor 200 receiving general RGB parallel color-values and temporarily storing the RGB parallel color-values, and then distinguishing and outputting the RGB parallel color-values for each subframe (field), a display unit 100, and a frame color-value storage unit 220 as illustrated in FIG. 8. The FSC image processor 200 receives the RGB parallel color-values through an interface unit 210 and temporarily stores the color-value in the frame color-value storage unit 220 in order to match a time difference between the color field to be sequentially displayed in the display unit 100 and the image output, sequentially reads the image values according to a predetermined order and a predetermined time from the frame color-value storage unit 220, and transmits a sequential color-value to the display unit 100 for each field.

By comparing with this, according to the field-sequential-color display device 1' according to an exemplary embodiment of the present invention may include an FSC brightness correction processor 300, the display unit 100, and an external brightness-correction-value storage unit 321 as illustrated in FIG. 9. The display unit 100 may include a pixel array 110 including a plurality of pixels located in an area where a plurality of scan lines and a plurality of data lines cross, a plurality of scan line drivers (not illustrated) including a circuit for driving the plurality of scan lines, and a plurality of data line drivers (not illustrated) including a circuit for driving the plurality of data lines. Here, the method described above in FIGS. 4A to 4C may be applied to the calculation of the brightness-correction-value for correcting the color field in the same/similar manner.

The field brightness-value calculation unit 330 may calculate a first field brightness-value (e.g., B(200)) in which the first field color-value (e.g., 200) of the first color field is expected to be displayed in the display device 100. The field correction-brightness-value calculation unit 340 may perform a calculation of subtracting a field transition-brightness-value (e.g., b(100)) transited from the previous color field of the first color field from the first field brightness-value, and output a first field correction-brightness-value (e.g., B'(200)).

The first field correction-brightness-value may be converted into the first field brightness-correction-value (e.g., 200') through the field brightness-correction-value calculation unit 350, and input into the display unit 100, and the display unit 100 combines the correction-brightness-value (e.g., B(200')) corresponding to the first field brightness-correction-value and the brightness-value (e.g., b(100)) transited in the previous field of the first field to display a corrected actual brightness (e.g., B^(200)).

In the present invention, it is exemplified that the field transition-brightness-value transited to the subsequent field is 10% of the corresponding color field brightness-value, but the present invention may be applied even to a case where a brightness-value transited due to a temperature change, etc., is 20%, 30%, etc., in the same/similar manner. The field brightness-correction-value calculation unit 350 may calculate the field brightness-correction-value corresponding to the field correction-brightness-value by using a correlation between the input color-value and the brightness-value of the display element. The calculated field brightness-correction-value (e.g., 200') may be stored in the field brightness-correction-value storage units 320 and 321, and the field transition-brightness-value calculation unit 360 may be used for calculating the second field correction-brightness-value (e.g., B'(100)) by reading the field transition-brightness-value (e.g., b(200)) from the field correction-brightness-value (e.g., B'(200), and subtracting the field transition-brightness-value (e.g., b(200)) from the second field brightness-value (e.g., B(100)) expected to be displayed in the display device 100 by the second field color-value (e.g. 100) of the second color field. The second field correction-brightness-value may be converted into the second field brightness-correction-value (e.g., 100') through the field brightness-correction-value calculation unit 350, and input into the display unit 100, and the display unit 100 combines the brightness-value (e.g., B(100')) corresponding to the second field brightness-correction-value and the brightness-value (e.g., b(200)) transited from the brightness-value of the first field to display a corrected actual brightness (e.g., B^(100)).

In the above-described example, the field transition-brightness-value is calculated from the field brightness-value, but according to another embodiment, the present invention may be applied even to a case where the field transition-brightness-value is calculated from the correction-brightness-value in the same/similar manner.

In FIG. 9, it is exemplified that the field brightness-correction-value storage unit 320 is a component inside the FSC brightness correction processor 300, but according to another embodiment, the field brightness-correction-value storage unit 320 may be implemented outside the FSC brightness correction processor 300 like the (external) field brightness-correction-value storage unit 321.

FIG. 10 relates to a field-sequential-color display device 1' according to another embodiment of the present invention and the embodiment of FIG. 9 is applied in the same/similar manner, but illustrates a case where the field brightness correction processor 400 is configured as a separate processor in addition to the FSC image processor 200. When the FSC image processor 200 or other image output devices output the field sequential color-value, the field brightness correction processor 400 is located in the front of the field sequential color display unit 100 to correct the color-value without a big change from the existing display component illustrated in FIG. 8. That is, in the case of FIG. 9, the FSC brightness correction processor 300 receiving the RGB parallel color-value processes even brightness correction conversion, while in the case of FIG. 10, the FSC image processor 200 receiving the RGB parallel color-value and the field brightness correction processor 400 processing the brightness correction conversion are implemented as separate components and only the field brightness correction processor 400 is simply added without physically transforming the existing components to obtain the same effect as FIG. 9.

According to FIG. 10, the field brightness correction processor 400 includes a field brightness-value calculation unit 430, a field correction-brightness-value calculation unit 440, a field brightness-correction-value calculation unit 450, a field transition-brightness-value calculation unit 460, and a field transition-brightness-value storage unit 470 to output a corrected sequential color-value (FSC-RGB) to the FSC display unit 100. Here, the method described above in FIGS. 4A to 4C, and FIG. 5 may be applied to calculation of the field transition-brightness-value and field color correction using the same in the same/similar manner.

Specifically, the FSC image processor 200 may receive the RGB parallel color-values through the interface unit 210, and temporarily store the received RGB parallel color-values in a frame buffer 220, and sequentially read the RGB parallel color-values stored in the frame buffer 220 and transmit an FSC-RGB field color-value to the field brightness correction processor 400.

The field brightness-value calculation unit 430 may calculate a first field brightness-value (e.g., B(200)) in which the first field color-value (e.g., 200) of the first color field is expected to be displayed in the display device 100. The field correction-brightness-value calculation unit 440 may perform a calculation of subtracting a brightness-value (e.g., b(100)) transited from the previous color field of the first color field from the first field brightness-value, and output a first field correction-brightness-value (e.g., B'(200)). The first field correction-brightness-value may be converted into the first field brightness-correction-value (e.g., 200') through the field brightness-correction-value calculation unit 450, and input into the display unit 100, and the display unit 100 combines the brightness-value (e.g., B(200')) corresponding to the first field brightness-correction-value and the brightness-value (e.g., b(100)) transited in the previous field of the first field to display a corrected brightness (e.g., B^(200)). In the present invention, it is exemplified that the field transition-brightness-value is 10% of the corresponding color field brightness-value, but the present invention may be applied even to a case where a brightness-value transited due to a temperature change, etc., is 20%, 30%, etc., in the same/similar manner.

The field brightness-correction-value calculation unit 450 may calculate the brightness-correction-value corresponding to the correction-brightness-value by using a correlation between the data and the brightness-value of the display element. At the same time, the field transition-brightness-value calculation unit 460 may calculate the first field transition-brightness-value (e.g., b(200)) transited form the first field correction-brightness-value (e.g., B'(200)) to the second field. The first field transition-brightness-value is stored in the field transition-brightness-value storage unit 470 for a field (subframe) time, and then the second field color-value (e.g., 100) of the second color field is subtracted from the second field brightness-value (e.g., B(100)) expected to be displayed in the display device 100 to be used for calculating the second field correction-brightness-value (e.g., B'(100)). The second field correction-brightness-value may be converted into the second field brightness-correction-value (e.g., 100') through the field brightness-correction-value calculation unit 450, and input into the display unit 100, and the display unit 100 combines the second field brightness-value (e.g., B(100')) corresponding to the second field brightness-correction-value and the brightness-value (e.g., b(200)) transited from the field brightness value of the first field to display a corrected actual brightness (e.g., B^(100)). In the above-described example, the field transition-brightness-value is calculated from the field correction-brightness-value, but according to another embodiment, the present invention may be applied even to a case where the field transition-brightness-value is calculated from the expectation field brightness-value in the same/similar manner.

In FIG. 10, it is exemplified that the field transition-brightness-value storage unit 470 is a component inside the field brightness correction processor 400, but according to another embodiment, the field transition-brightness-value storage unit 470 may be implemented outside the field brightness correction processor 400 like the (external) field brightness-correction-value storage unit 471.

FIG. 11 relates to a field-sequential-color display device 1' according to another embodiment of the present invention and the embodiment of FIG. 10 is applied in the same/similar manner, but illustrates a case where the field brightness correction processor 500 is configured in the field sequential color display unit 101. FIG. 11 illustrates a configuration example in which the field sequential color-value output from the FSC image processor 200 or other image output device is directly input into the FSC display unit 101 and the field brightness correction processor 500 in the FSCI display unit 101 corrects the color-value.

The field brightness correction processor 500 includes a field brightness-value calculation unit 530, a field correction-brightness-value calculation unit 540, a field brightness-correction-value calculation unit 550, a field transition-brightness-value calculation unit 560, and a field transition-brightness-value storage unit 570, and transfers the corrected FSC-RGB color-value to the pixel array 110 similar to the external field brightness correction processor 400 of FIG. 10. Here, the method described above in FIGS. 4A to 4C, and FIG. 5 may be applied to calculation of the field transition-brightness-value and field color correction using the same in the same/similar manner.

Specifically, the FSC image processor 200 may receive the RGB parallel color-values through the interface unit 210, and temporarily store the received RGB parallel color-values in a frame buffer 220, and sequentially read the RGB parallel color-values stored in the frame buffer 220 and transmit an FSC-RGB field color-value to the field brightness correction processor 500 inside the field sequential color correction display unit 101.

The field brightness-value calculation unit 530 may calculate a first field brightness-value (e.g., B(200)) in which the first field color-value (e.g., 200) of the first color field is expected to be displayed in the display device 101. The field correction-brightness-value calculation unit 540 may perform a calculation of subtracting a brightness-value (e.g., b(100)) transited from the previous color field of the first color field from the first field brightness-value, and output a first field correction-brightness-value (e.g., B'(200)). The first field correction-brightness-value may be converted into the first field brightness-correction-value (e.g., 200') through the field brightness-correction-value calculation unit 550, and input into the field sequential color correction display unit 101, and the field sequential color correction display unit 100 combines the brightness-value (e.g., B(200')) corresponding to the first field brightness-correction-value and the brightness-value (e.g., b(100)) transited in the previous field of the first field to display a corrected brightness (e.g., B^(200)). In the present invention, it is exemplified that the transition-brightness-value is 10% of the corresponding color field brightness-value, but the present invention may be applied even to a case where a brightness-value transited due to a temperature change, etc., is 20%, 30%, etc., in the same/similar manner.

The field brightness-correction-value calculation unit 550 may calculate the brightness-correction-value corresponding to the correction-brightness-value by using a correlation between the input color-value and the brightness of the display element. The field transition-brightness-value calculation unit 560 may calculate the first transition-brightness-value (e.g., b(200)) transited form the first field correction-brightness-value (e.g., B'(200)) to the second field. The first field transition-brightness-value is stored in the field transition-brightness-value storage unit 570 for a field (subframe) time, and then the second field color-value (e.g., 100) of the second color field is subtracted from the second field brightness-value (e.g., B(100)) expected to be displayed in the display device 101 to be used for calculating the second field correction-brightness-value (e.g., B'(100)). The second field correction-brightness-value may be converted into the second field brightness-correction-value (e.g., 100') through the field brightness-correction-value calculation unit 550, and input into the display unit 101, and the field sequential color correction display unit 101 may display a corrected actual brightness (e.g., B^(100)) acquired by aggregating the correction-brightness-value (e.g., B(100')) corresponding to the second field brightness-correction-value and the brightness-value (e.g., b(200)) transited from the brightness-value of the first field. In the above-described example, the transition-brightness-value is calculated from the expectation field brightness value, but according to another embodiment, the present invention may be applied even to a case where the transition-brightness-value is calculated from field correction-brightness-value in the same/similar manner.

In FIG. 11, it is exemplified that the field transition-brightness-value storage unit 570 is a component inside the field transition brightness correction processor 500 and the field sequential color correction display unit 101, but according to another embodiment, the field transition-brightness-value storage unit 570 may be configure outside the field transition brightness correction processor 500 or the field sequential color correction display unit 101 like the (external) field brightness-correction-value storage unit 321 of FIG. 9.

An application example of a system is illustrated in FIGS. 12A and 12B, FIGS. 13A and 13B, and FIGS. 14A and 14B.

Figure 12A:
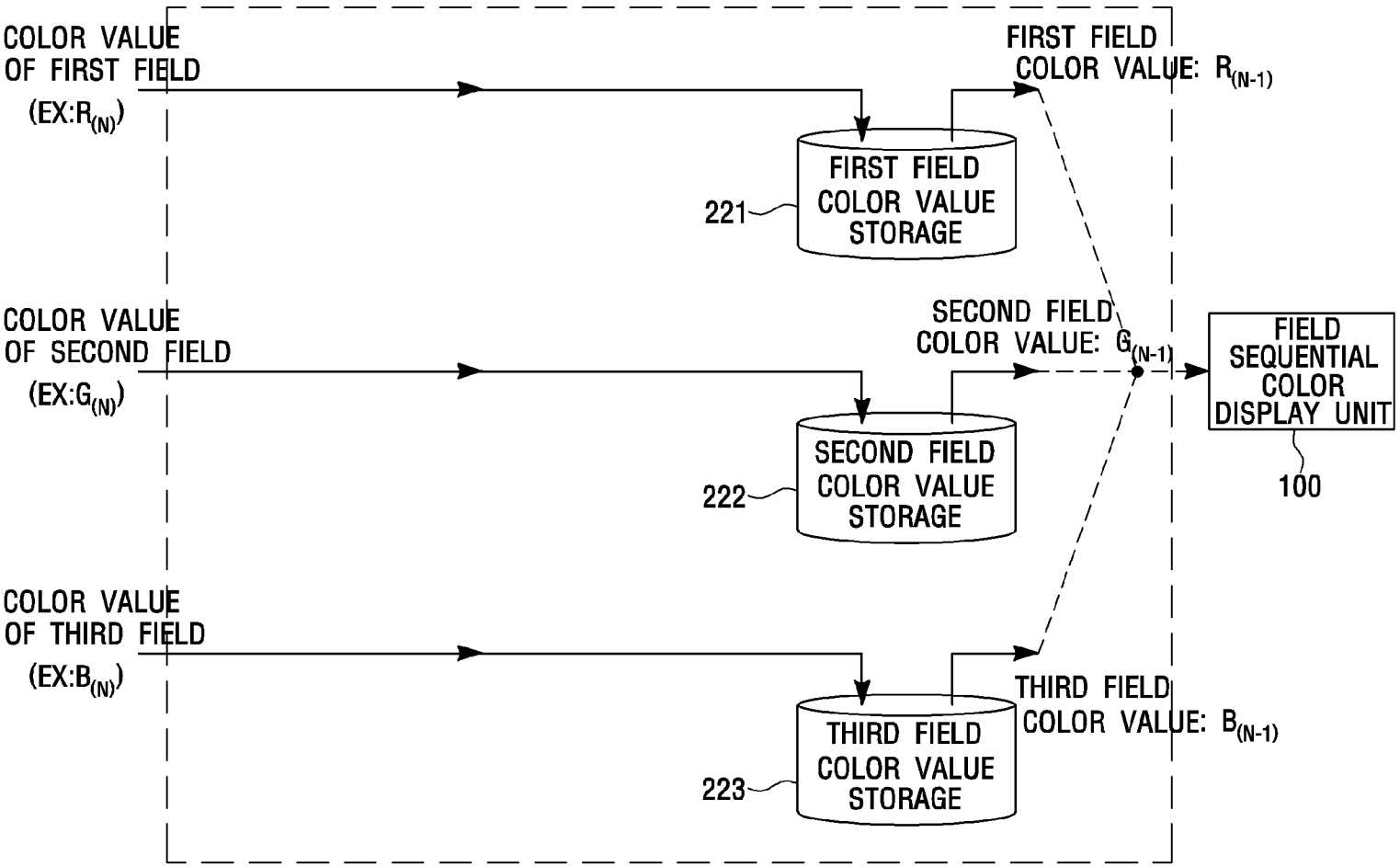
FIG. 12A is a system configuration diagram for describing an existing FSC image processor that switches an input RGB parallel color-value into a sequential field color-value, and sequentially outputs the sequential field color-value for each color field.
Figure 12B:
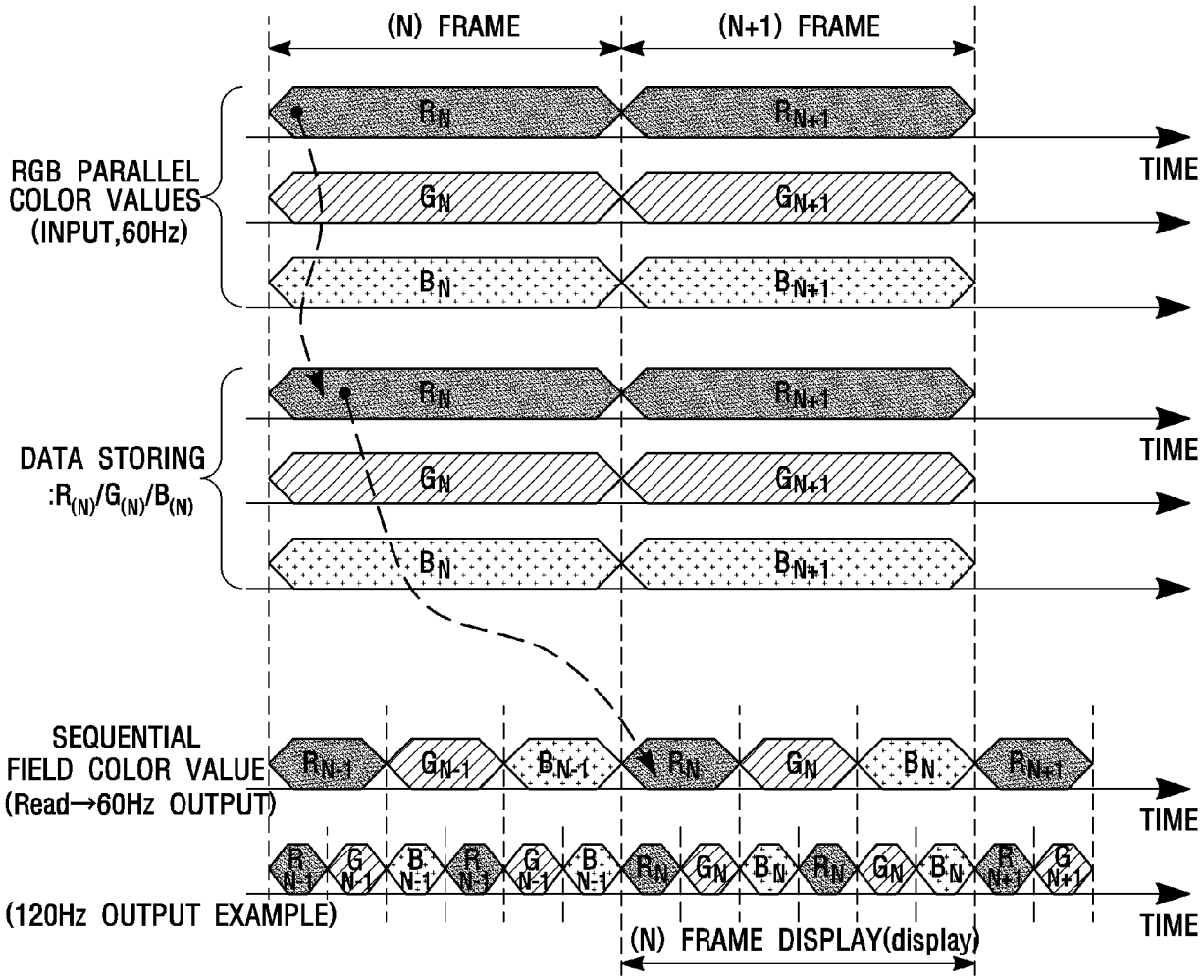
FIG. 12B is a diagram illustrating a timing example.

FIG. 12A is a diagram schematically illustrating an internal configuration of the FSC image processor 200 based on the general field-sequential-color display device 1 of FIG. 8. When the RGB parallel color-value is input at a frame rate of 60 Hz as in the timing diagram of FIG. 12B, the color-value is stored in the frame color-value storage unit 220, and then distinguished into the color-value for each RGB, and sequentially transmitted to the field sequential color display unit 100. The frame color-value storage unit 220 may be separately constituted by a first field color-value storage 221, a second field color-value storage 222, and a third field color-value storage 223.

Figure 13A:
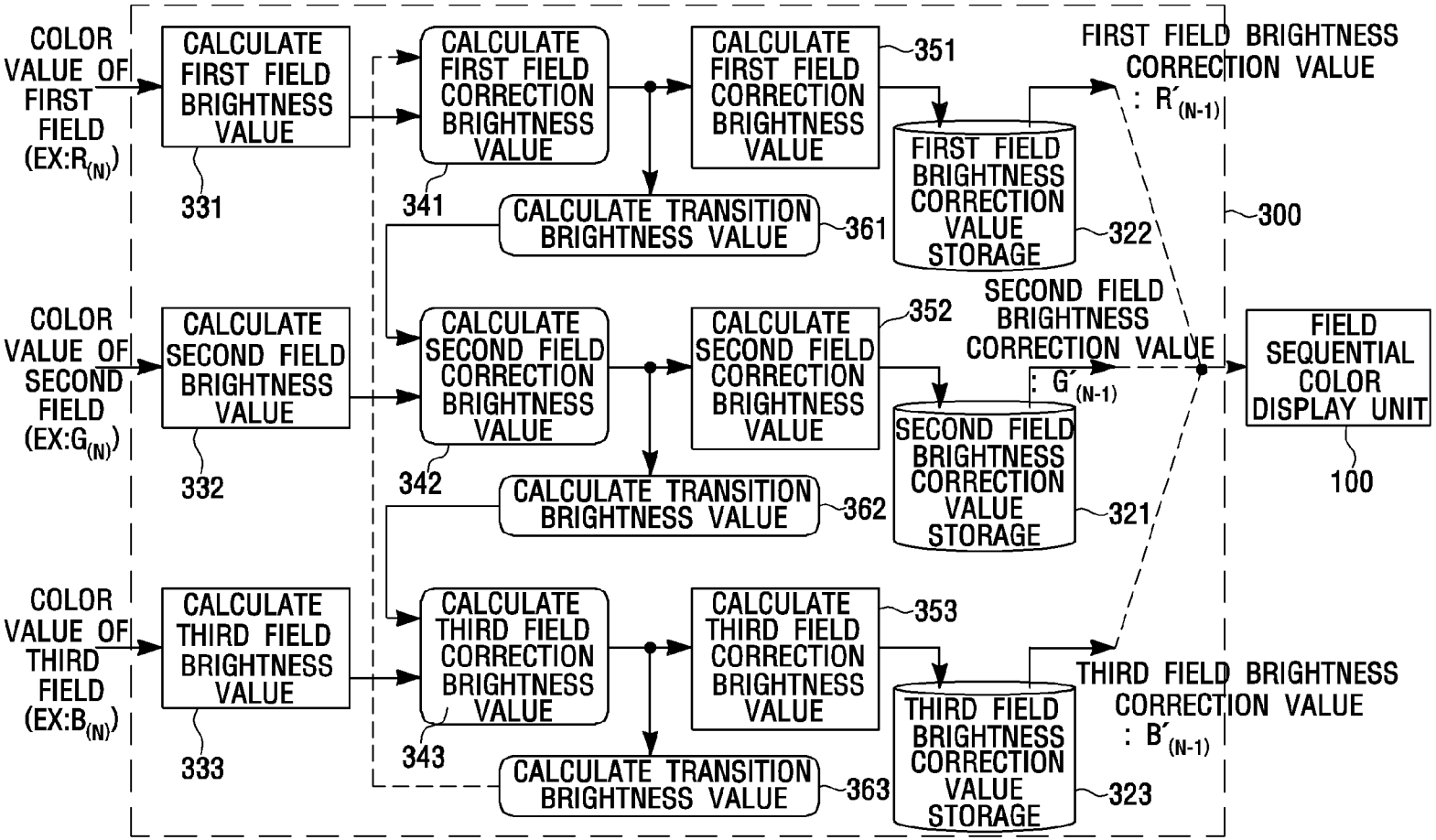
FIG. 13A is a system configuration diagram for describing the FSC brightness correction processor and the FSC display device to which the brightness correction method of the field-sequential-color display proposed in the present invention is applied as in FIG. 9, and FIG. 13B a diagram illustrating a processing operation timing example.

FIG. 13A illustrates an example showing internal components in the FSC brightness correction processor 300 and a data processing flow for transition brightness correction based on the brightness correction field sequential color display device 1' of FIG. 9. As in the timing diagram of FIG. 13B, a case where RED of the RGB parallel color-value is displayed in the first field, GREEN is displayed in the second field, and BLUE is displayed in the third field is exemplified. An input RED color-value is switched to a first field brightness-value $\{B(R_{(N)})\}$ in the first field brightness-value calculation unit 331, and the first field correction-brightness-value calculation unit 341 calculates a first field correction-brightness-value $\{B(R'_{(N)})\}$ by subtracting a third field transition-brightness-value $\{b(B_{(N-1)})\}$ transited in the third field (last) of a previous frame (N−1) from the first field brightness-value $\{B(R_{(N)})\}$. The first field transition-brightness-value calculation unit 361 calculates a brightness-value to be transited to the subsequent field from the first field brightness-value $\{B(R_{(N)})\}$ or the first field correction-brightness-value $\{B(R'_{(N)})\}$ to output a first field transition-brightness-value $\{b(R_{(N)})\}$ to the second field correction-brightness-value calculation unit 342. At the same time, the first field brightness-correction-value calculation unit 351 calculates the first field brightness-correction-value $(R'_{(N)})$ and stores the calculated first field brightness-correction-value $(R'_{(N)})$ in the first field brightness-correction-value storage 321 by considering the brightness response characteristic of the display unit.

An input GREEN color-value is switched to a second field brightness-value $\{B(G_{(N)})\}$ in the second field brightness-value calculation unit 332 simultaneously with the RED color-value, and the second field correction-brightness-value calculation unit 342 calculates a second field correction-brightness-value $\{B(G'_{(N)})\}$ by subtracting a first field transition-brightness-value $\{b(R_{(N)})\}$ transited in the first field from the second field brightness-value $\{B(G_{(N)})\}$. The second field transition-brightness-value calculation unit 362 calculates a brightness-value to be transited to the third field from the second field brightness-value $\{B(G_{(N)})\}$ or the second field correction-brightness-value $\{B(G'_{(N)})\}$ to output a second field transition-brightness-value $\{b(G_{(N)})\}$ to the third field correction-brightness-value calculation unit 343. At the same time, the second field brightness-correction-value calculation unit 352 calculates the second field brightness-correction-value $(G'_{(N)})$ and stores the calculated second field brightness-correction-value $(G'_{(N)})$ in the second field brightness-correction-value storage 322 by considering the brightness response characteristic of the display unit.

An input BLUE color-value is also switched to a third field brightness-value $\{B(B_{(N)})\}$ in the third field brightness-value calculation unit 333 simultaneously with the RED and GREEN color-values, and the third field correction-brightness-value calculation unit 343 calculates a third field correction-brightness-value $\{B(B'_{(N)})\}$ by subtracting a third field transition-brightness-value $\{b(G_{(N)})\}$ transited in the second field from the third field brightness value $\{B(B_{(N)})\}$. The third field transition-brightness-value calculation unit 363 calculates a brightness-value to be transited to the subsequent field from the third field brightness-value $\{B(B_{(N)})\}$ or the third field correction-brightness-value $\{B(B'_{(N)})\}$ to output a third field transition-brightness-value $\{b(B_{(N)})\}$ to the first field correction-brightness-value calculation unit 341. At the same time, the third field brightness-correction-value calculation unit 353 calculates the third field brightness-correction-value $(B'_{(N)})$ and stores the calculated third field brightness-correction-value $(B'_{(N)})$ in the third field brightness-correction-value storage 323 by considering the brightness response characteristic of the display unit.

Figure 13B:
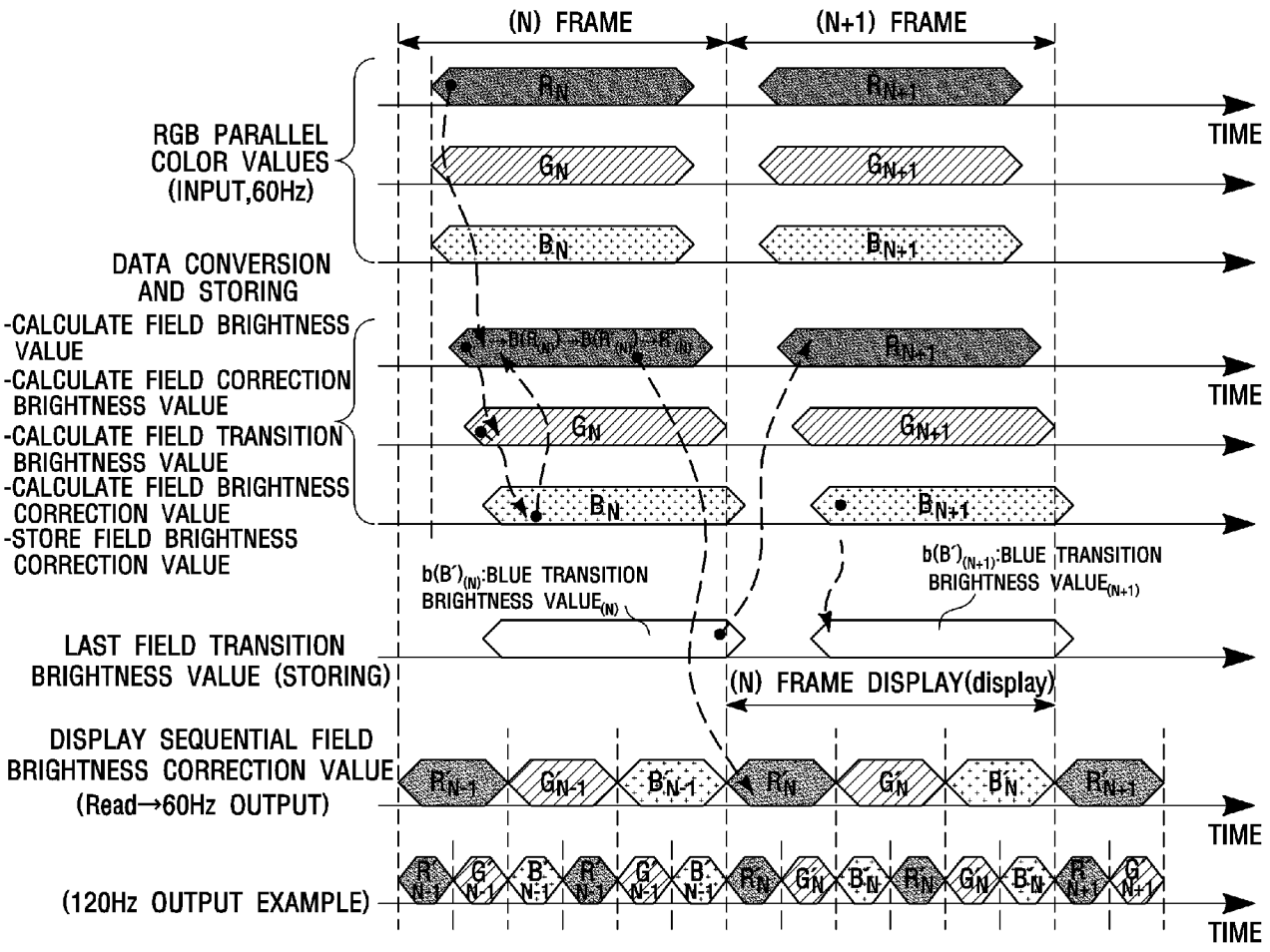

When the RGB parallel color-value are input at the frame rate of 60 Hz, the RGB color-values simultaneously input like the timing diagram of FIG. 13B to simultaneously store, in each of the field brightness-correction-value storages, a color-value of which brightness is corrected by performing calculation of an (expected) brightness-value, calculation of a correction-brightness-value, calculation of a transition-brightness-value, and calculation of the brightness-correction-value. The RGB brightness-correction-values stored in the first field brightness-correction-value storage 321, the second field brightness-correction-value storage 322, and the third field brightness-correction-value storage 323 may be read according to the field order and sequentially output to the field sequentially color display 100 for each field $(R'_{(N)}>G'_{(N)}>B'_{(N)})$, and data stored in the brightness-correction-value storage may be quickly read and output, and transmitted to a 120 Hz frame.

Figure 14A:
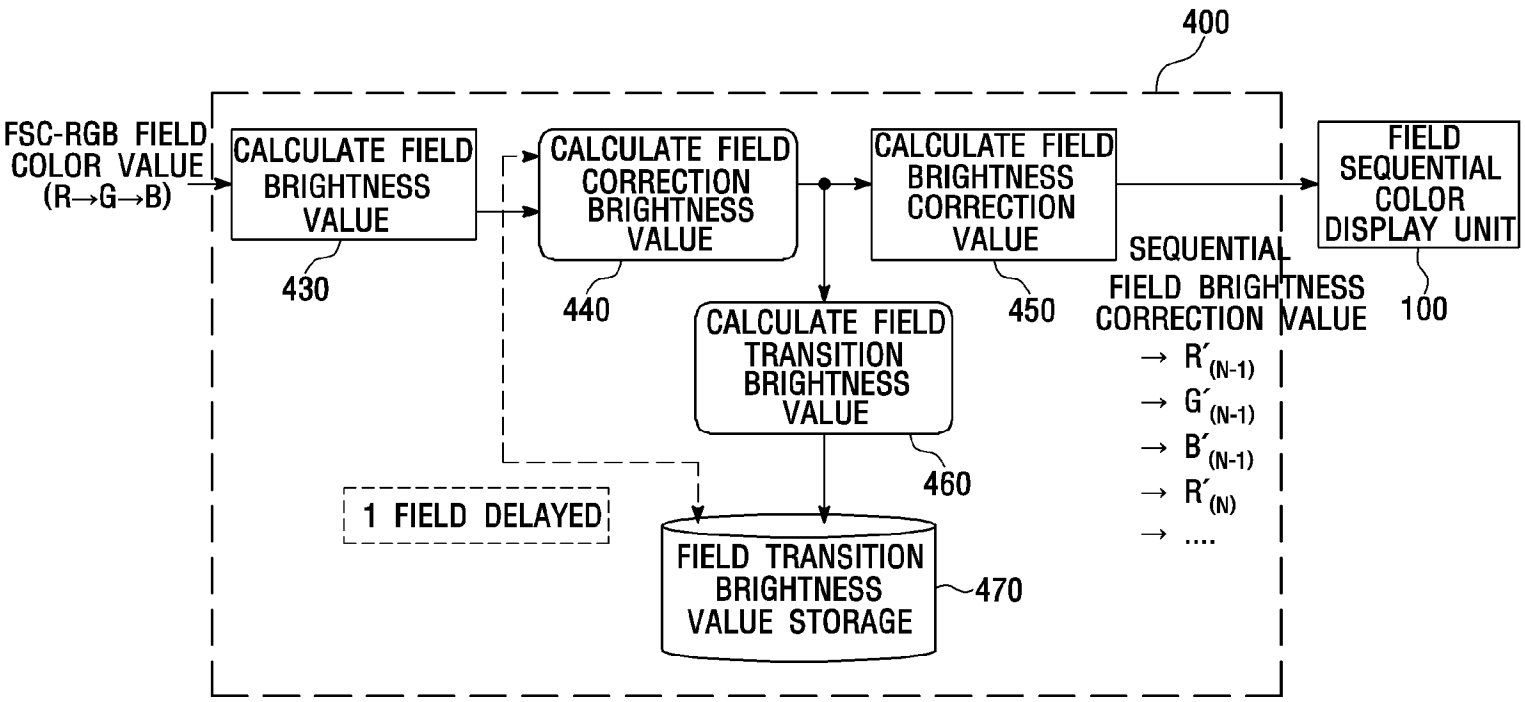
FIG. 14A is a system configuration diagram for describing a field-sequential-color display device including a field transition brightness correction processor (unit) to which the brightness correction method of the FSC display proposed in FIGS. 10 and 11 is applied, and FIG. 14B a diagram illustrating a processing operation timing example.

FIG. 14A illustrates an example showing a color-value processing flow for correcting transition brightness with internal components in field brightness correction processors 400 and 500 based on the brightness correction field sequential color display device 1' of FIGS. 10 and 11. Sequential FSC-RGB color-values are input into the field brightness correction processors 400 and 500 from the FSC image processor 200. A first field RED color-value is switched to the first field expectation-brightness-value $\{B(R_{(N)})\}$ in the field brightness-value calculation unit 430, and the field correction-brightness-value calculation unit 440 calculates a first field correction-brightness-value $\{B(R'_{(N)})\}$ by subtracting a field transition-brightness-value $\{b(B_{(N-1)})\}$ transited in the last field of a previous frame (N−1) stored in the field transition-brightness-value storage 470 from the first field brightness-value $\{B(R_{(N)})\}$. The field transition-brightness-value calculation unit 460 calculates a brightness-value to be transited to the second field from the first field brightness-value $\{B(R_{(N)})\}$ or the first field correction-brightness-value $\{B(R'_{(N)})\}$ to return and output a first field transition-brightness-value $\{b(R_{(N)})\}$ to the field correction-brightness-value calculation unit 440. At the same time, the field brightness-correction-value calculation unit 450 calculates the first field brightness-correction-value $(R'_{(N)})$ and outputs the calculated first field brightness-correction-value $(R'_{(N)})$ in the field sequential color display units 100 and 110 by considering the brightness response characteristic of the display unit.

A second field GREEN color-value is switched to the second field brightness-value $\{B(G_{(N)})\}$ in the field brightness-value calculation unit 430, and the field correction-brightness-value calculation unit 440 calculates a second field correction-brightness-value $\{B(G'_{(N)})\}$ by subtracting a first field transition-brightness-value $\{b(R_{(N)})\}$ transited in the first field from the second field brightness-value $\{B(G_{(N)})\}$. The field transition-brightness-value calculation unit 460 calculates a brightness-value to be transited to the third field from the second field brightness-value $\{B(R_{(N)})\}$ or the second field correction-brightness-value $\{B(G'_{(N)})\}$ to return and output a second field transition-brightness-value $\{b(G_{(N)})\}$ to the field correction-brightness-value calculation unit 440. At the same time, the field brightness-correction-value calculation unit 450 calculates the second field brightness-correction-value $(G'_{(N)})$ and outputs the calculated second field brightness-correction-value $(G'_{(N)})$ in the field sequential color display units 100 and 110 by considering the brightness response characteristic of the display unit.

A third field BLUE color-value is switched to the third field brightness-value $\{B(B_{(N)})\}$ in the field brightness-value calculation unit 430, and the field correction-brightness-value calculation unit 440 calculates a third field correction-brightness-value $\{B(B'_{(N)})\}$ by subtracting a second field transition-brightness-value $\{b(G_{(N)})\}$ transited in the second field from the third field brightness-value $\{B(B_{(N)})\}$. The field transition-brightness-value calculation unit 460 calculates a brightness-value to be transited to the first field of a subsequent (N+1) frame from the third field brightness-value $\{B(B_{(N)})\}$ or the third field correction-brightness-value $\{B(B'_{(N)})\}$ and stores the calculated brightness-value in the field transition-brightness-value storage unit 470. At the same time, the field brightness-correction-value calculation unit 450 calculates the third field brightness-correction-value ($B'_{(N)}$) and outputs the calculated third field brightness-correction-value ($B'_{(N)}$) to the field sequential color display units 100 and 110 by considering the brightness response characteristic of the display unit.

Figure 14B:
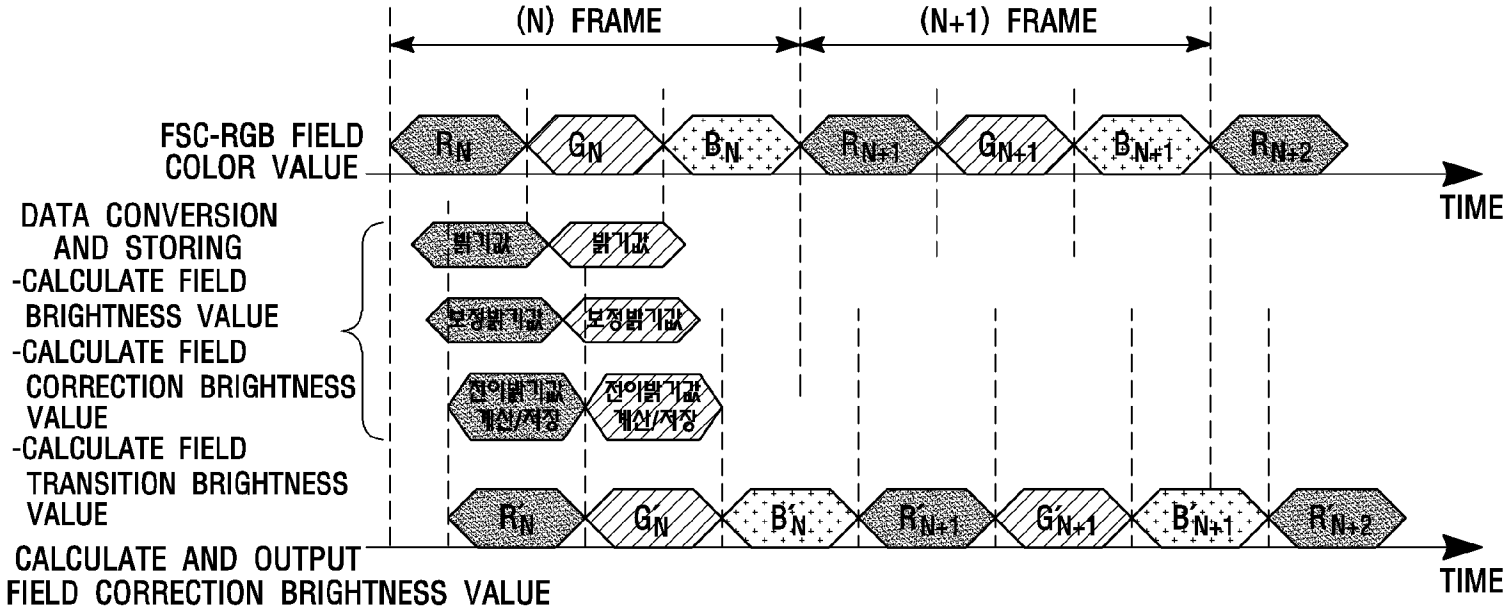

When the FSC-RGB color-values are input at a frame rate of 3×60 Hz, the brightness correction may be processed by sequentially performing the processes of the calculation of the expectation-brightness-value, the calculation of the correction-brightness-value, the calculation and storing of the transition-brightness-value, and the calculation and output of the brightness-correction-value like the timing diagram of FIG. 14*b*. Since the field color-values (e.g., $R_{(N)}/G_{(N)}/B_{(N)}$) are sequentially input, the field brightness-correction-values (e.g., $R'_{(N)}/G'_{(N)}/B'_{(N)}$) may be sequentially output to the field sequential color displays 100 and 110 by repeatedly performing the brightness correction process according to an input order, and an output frame rate may be equal to an input frame rate.

Operations such as the calculation of the expectation-brightness-value, the calculation of the correction-brightness-value, the calculation and storing of the transition-brightness-value, and the calculation and output of the brightness-correction-value are performed in synchronization with an input clock of the image color-value, and the field transition-brightness-value output after being stored in the last field transition-brightness-value storage 470 outputs a one-field (subframe) delayed value. That is, the field brightness correction processors 400 and 500 refer to a field transition-brightness-value corresponding to a last color field last driven among a plurality of color fields divided from a first frame to calculate a brightness-correction-value corresponding to an initial field initially driven among a plurality of color fields divided from a second frame driven next to the first frame.

Consequently, as in FIGS. 13A and 13B, the FSC brightness correction processor 300 according to the embodiment may simultaneously receive a plurality of color-values corresponding to a plurality of color fields, and calculate all brightness-correction-values corresponding to the plurality of color-values, respectively, and store the calculated brightness-correction-values in the brightness-correction-value storage, and then sequentially output the brightness-correction-values for each field, and the field sequential color display unit 100 may sequentially output brightness-values corresponding to a plurality of brightness-correction-values, respectively based on the brightness-values corresponding to the stored and transmitted brightness-correction-values, respectively.

Alternatively, the field brightness correction processors 400 and 500 according to another embodiment illustrated in FIGS. 14A and 14B may sequentially receive color-values corresponding to color-values corresponding to a plurality of color fields for each color field and calculate a first field brightness-correction-value corresponding to a first color-value of a first field, the field sequential color display unit 100 may output a brightness-value corresponding to the calculated first field brightness-correction-value, and thereafter, the field brightness correction processors 400 and 500 may calculate a second field brightness-correction-value corresponding to a second color-value of a second color field, and the field sequential color display unit 100 may sequentially output brightness-values corresponding to the calculated second field brightness-correction-value.

Figure 15A:
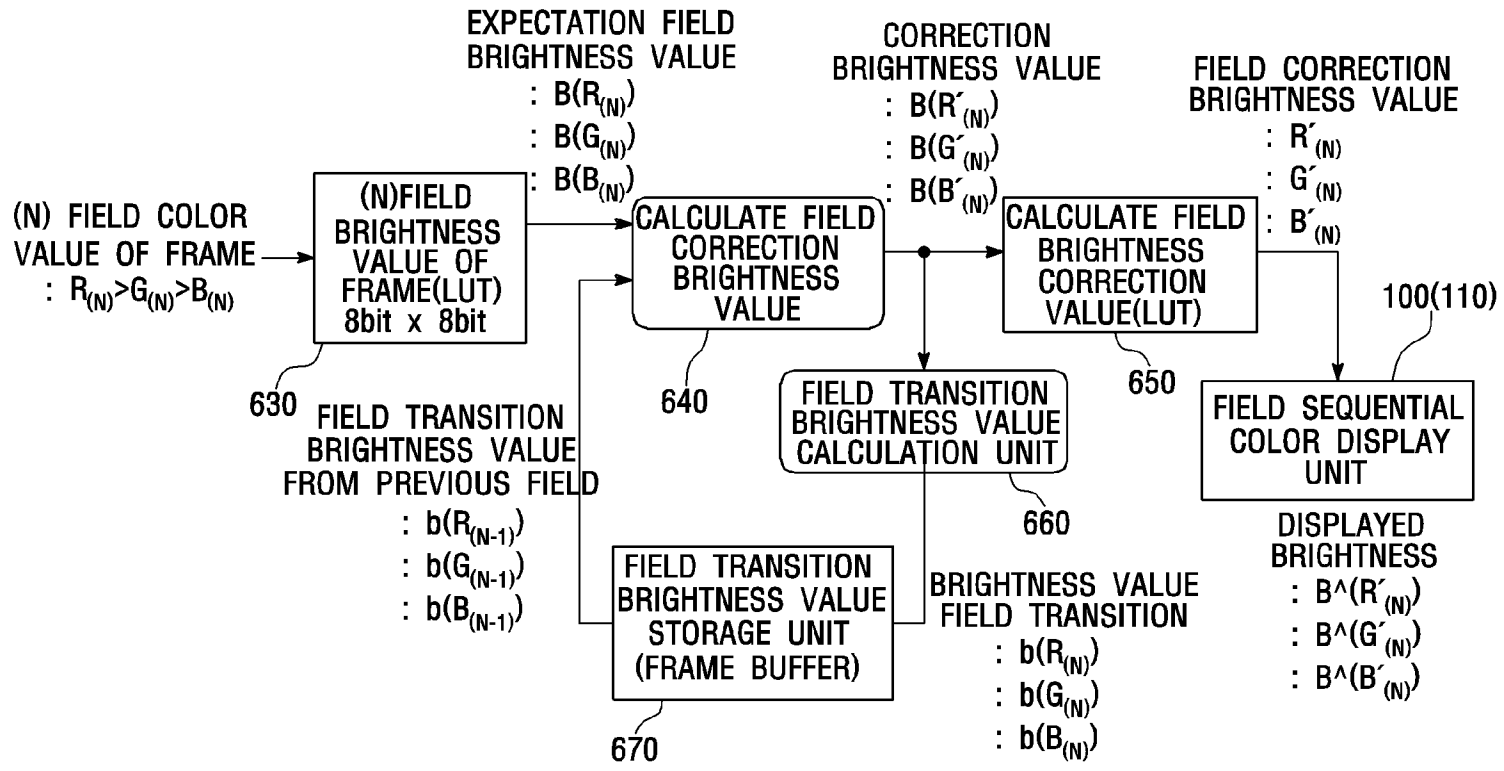
FIGS. 15A and 15B are conceptual diagrams for describing a method for implementing a field brightness-value calculation unit and a brightness-correction-value calculation unit by a Look-up Table scheme in a field-sequential-color display device proposed in the present invention.
Figure 15B:
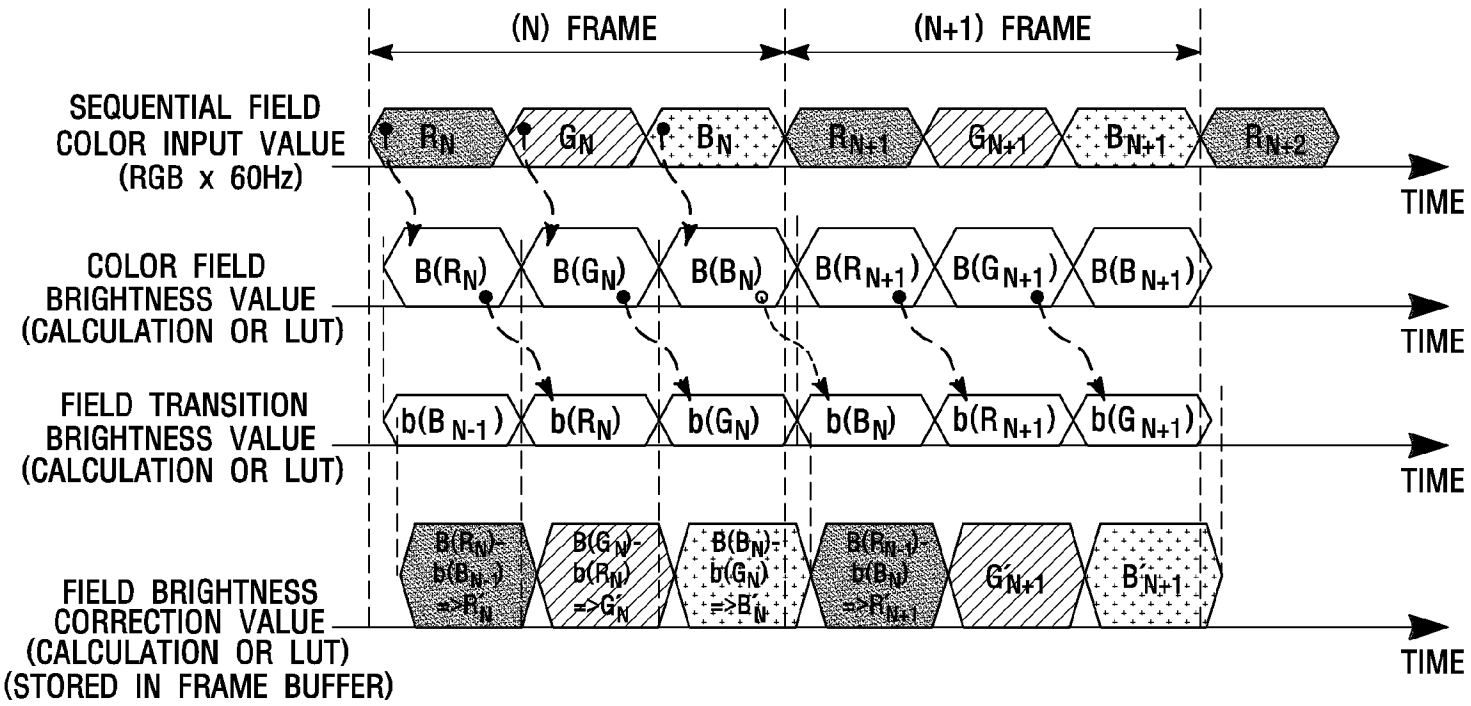

FIGS. 15A and 15B illustrate configuration examples of implementing a function to calculate a brightness of a field sequential color display by using a Look-up Table proposed in the present invention. Among components of FIG. 14A, the field brightness-value calculation units 330, 430, and 530, and the field brightness-correction-value calculation units 350, 450, and 550 may be changed to a form such as a Look-up Table (LUT) illustrate in FIG. 15A, and configured. When a complicated equation is changed to a mapping type LUT format, quick calculation processing becomes possible. The field brightness-value calculation unit 630 may be implemented as an LUT having a storage space of a capacity of (8 bit×8 bit) with respect to an 8-bit input image, and the field brightness-correction-value calculation unit 650 may also be implemented as the LUT having the storage space of the capacity of (8 bit×8 bit).

Figure 3A:
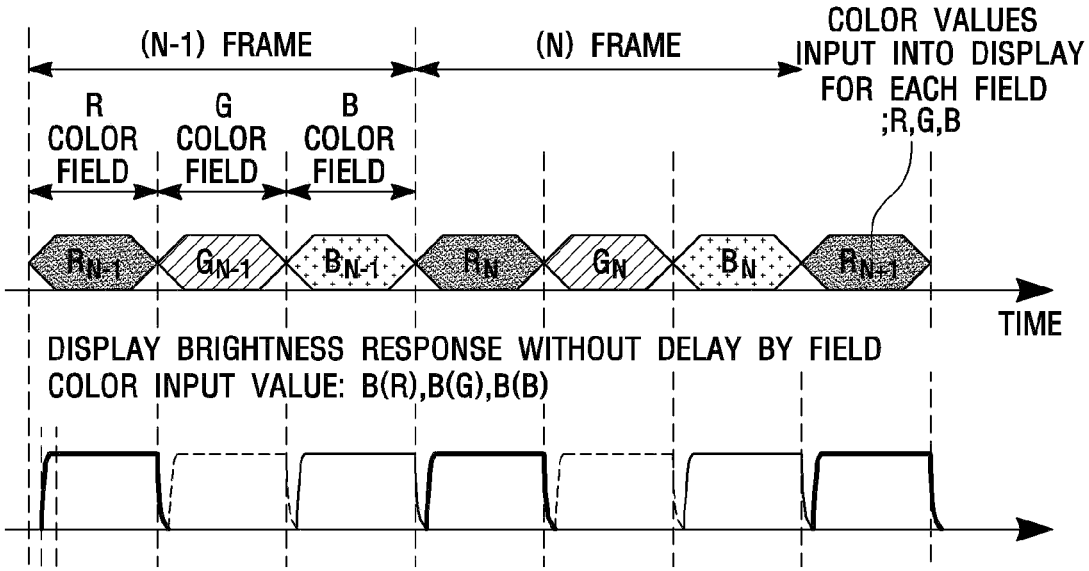
FIGS. 3A-C illustrate a timing example for describing a phenomenon of color mixing, which occurs due to a difference between a subframe (color field) time and a response time of display element in a field sequential color method.
Figure 3B:
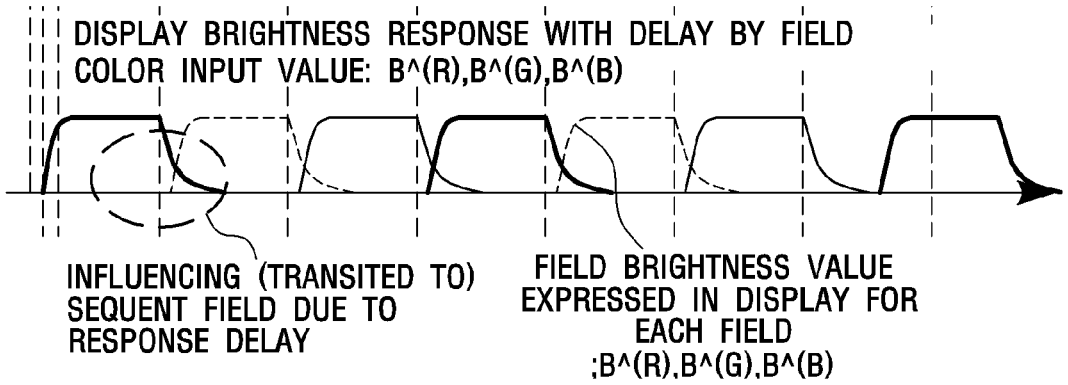
Figure 3C:
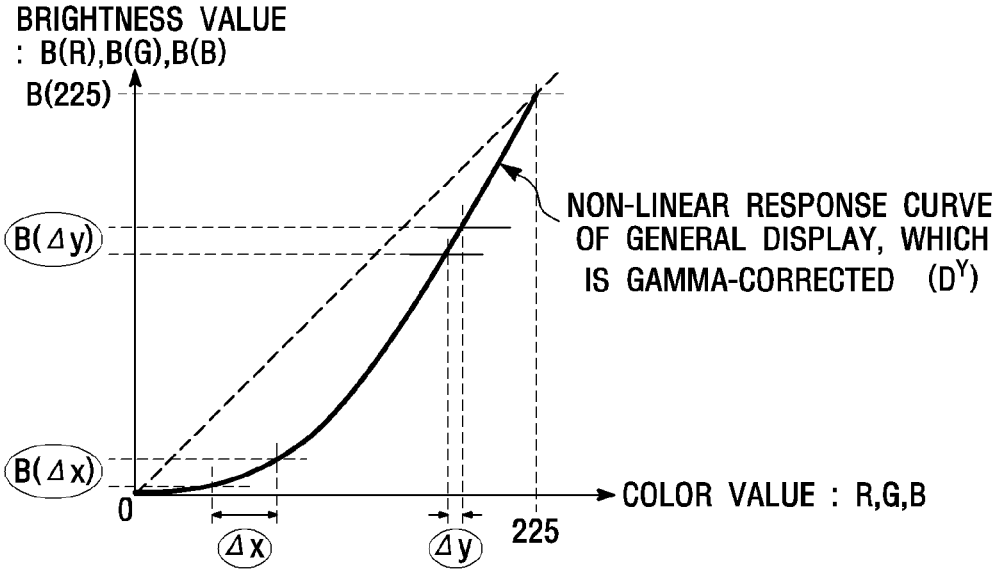

As described above, in calculating the transition brightness, the field-sequential-color display device according to the present invention processes the calculation based on a display brightness-value having the non-linear characteristic (see FIG. 3C) other than the color-value having the linear characteristic. Therefore, there is an advantage of providing a method which expresses a vivid color with excellent color expression power by improving a problem in that color brightnesses of R, G, and B which should be sequentially distinguished and expressed are mixed due to a difference between a time of a color field and a response time of a display element in a field-sequential-color display device, and as a result, an accurate color may not be implemented. Further, correction data is calculated by reflecting a brightness-value transited between color fields in a display to a non-linear brightness-value displayed in the corresponding field to minimize an error caused due to a difference between linear image data and a non-linear brightness-value displayed in the display.

Hereinabove, features, structures, effects, and the like described in the exemplary embodiments are included in one embodiment of the present invention, and are not particularly limited to only one embodiment. Further, features, structures, effects, and the like exemplified in each embodiment may be carried out while being combined or modified for other exemplary embodiments by those skilled in the art to which the exemplary embodiments pertain. Therefore, the contents related to such combinations and modifications should be interpreted as being included in the scope of the present invention.

Although exemplary embodiments of the present invention have been mainly described above, these are merely examples and do not limit the present invention, and those skilled in the art to which the present invention pertains will know that various modifications and applications not illustrated above can be made within the scope without departing from the essential characteristics of the embodiment. For example, each component specifically shown in the embodiment may be implemented by being modified. In addition, it will be interpreted that differences related to the modifications and applications are included in the scope of the present invention defined in the appended claims.

What is claimed is:

1. A field-sequential-color display device sequentially driving a plurality of color fields divided from any one frame of a plurality of frames, comprising;

a processor calculating a second field brightness-correction-value of a second color field based on a first field transition-brightness-value transferred from a first color field; and a display unit controlling the second color field based on the second field brightness-correction-value, wherein the processor calculates a second field correction-brightness-value by calculating the first field transition-brightness-value in which a portion of first field brightness-values of the first color field are transferred to a brightness-value of a second color field with a second field brightness-value corresponding to a second field color-value of the second color field, and calculates the second field brightness-correction-value by referring to at least one of the second field brightness-value and the second field correction-brightness-value, wherein a predetermined field transition-brightness-value corresponding to a portion of the first field brightness-values of the first color field is transferred to the second field brightness-value of the second color field, and the processor calculates the second field correction-brightness-value by using the predetermined field transition-brightness-value.

2. The field-sequential-color display device of claim 1, wherein the display unit outputs a field brightness-value corresponding to the calculated second field brightness-correction-value to the second color field.

3. The field-sequential-color display device of claim 1, wherein a brightness response curve of the display has a non-linear characteristic.

4. The field-sequential-color display device of claim 1, wherein the processor determines the predetermined field transition-brightness-value by referring to at least one of a brightness-correction-value, a response time of a display element, and a frequency of a color field.

5. The field-sequential-color display device of claim 1, wherein the processor calculates the second field correction-brightness-value by adding or subtracting the predetermined field transition-brightness-value to or from the second field brightness-value of the second color field.

6. The field-sequential-color display device of claim 1, wherein the processor simultaneously receives all of a plurality of color-values corresponding to a plurality of color fields, and calculates all of a plurality of field brightness-correction-values corresponding to the plurality of field color-values, respectively, and the display unit sequentially outputs field brightness-values corresponding to the plurality of field brightness-correction-values, respectively.

7. The field-sequential-color display device of claim 6, further comprising:

a storage unit storing the plurality of field brightness-correction-values, wherein the display unit sequentially outputs the field brightness-values corresponding to the plurality of field brightness-correction-values stored in the storage unit.

8. The field-sequential-color display device of claim 7, wherein the storage unit separately stores a predetermined field transition-brightness-value transferred to the field brightness-value of the second color field as a portion of the first field brightness-values of the first color field, and the processor reads the predetermined field transition-brightness-value stored in the storage unit and calculates the plurality of field brightness-correction-values.

* * * * *